United States Patent [19]

Tomii et al.

[11] Patent Number: 5,053,673

[45] Date of Patent: Oct. 1, 1991

[54] FIELD EMISSION CATHODES AND METHOD OF MANUFACTURE THEREOF

[75] Inventors: Kaoru Tomii, Isehara; Akira Kaneko, Tokyo; Toru Kanno, Kawasaki, all of Japan

[73] Assignee: Matsushita Electric Industrial Co., Ltd., Japan

[21] Appl. No.: 422,883

[22] Filed: Oct. 17, 1989

[30] Foreign Application Priority Data

| | | | |
|---|---|---|---|
| Oct. 17, 1988 | [JP] | Japan | 63-260807 |
| Mar. 13, 1989 | [JP] | Japan | 1-59906 |
| May 19, 1989 | [JP] | Japan | 1-126945 |
| May 19, 1989 | [JP] | Japan | 1-126950 |

[51] Int. Cl.[5] ..... H01J 1/46

[52] U.S. Cl. ..... 313/308; 313/309; 313/336

[58] Field of Search ..... 313/308, 309, 336

[56] References Cited

U.S. PATENT DOCUMENTS

| | | | |
|---|---|---|---|
| 3,665,241 | 5/1972 | Spindt et al. | 313/336 |
| 4,827,177 | 5/1989 | Lee et al. | 313/336 |
| 4,954,744 | 9/1990 | Suzuki et al. | 313/309 |
| 4,956,574 | 9/1990 | Kane | 313/308 |

FOREIGN PATENT DOCUMENTS

| | | |
|---|---|---|
| 54-17551 | 6/1979 | Japan . |
| 61-502151 | 9/1986 | Japan . |
| 85/05491 | 12/1985 | PCT Int'l Appl. . |
| 88/01098 | 2/1988 | PCT Int'l Appl. . |

OTHER PUBLICATIONS

G. Labrunie et al., "Novel Type of Emissive Flat Panel Display: The Matrixed Cold-Cathode Microtip Fluorescent Display", *Display*, Jan., 1987, pp. 37-39.

C. A. Spindt, "A Thin-Film Field-Emission Cathode", *Journal of Applied Physics*, vol. 39, p. 3504, Feb. 1968.

*Primary Examiner*—Donald J. Yusko

*Assistant Examiner*—Diab Hamadi

*Attorney, Agent, or Firm*—Lowe, Price, LeBlanc & Becker

[57] ABSTRACT

Structures and methods of manufacture for field emission cathodes having cathode tips of minute size, whereby a block formed of pairs of substrates each having a patterned thin layer of cathode material sandwiched therebetween is sliced into a plurality of sections, to obtain array substrates each having an array of exposed regions of cathode material. A metal layer for constituting electron extraction electrodes and corresponding extraction apertures is formed over these exposed regions and appropriately shaped, after first forming mask layer portions upon the exposed cathode material regions.

8 Claims, 16 Drawing Sheets

FIELD EMISSION CATHODES AND METHOD OF MANUFACTURE THEREOF

BACKGROUND OF THE INVENTION

1. Field of Applicable Technology

The present invention relates to structures and methods of manufacture for field emission cathodes of microtip configuration, functioning by cold-cathode electron emission, which can be formed as high-density arrays for use in such applications as matrixed flat panel display devices.

2. Prior Art Technology

When a field emission cathode is utilized as an electron source in a vacuum electronic device, it is necessary to generate an electric field strength of approximately $10^6$ volts/cm in order to achieve electron emission. However if such a field emission cathode is formed with a tip which has a radius of curvature of less than 10 μm, i.e. is formed with a sharply pointed tip, then the electrical field that is generated as a result of applying a voltage between that field emission cathode and a corresponding electron emission electrode in a vacuum will be concentrated at the tip of the cathode. As a result, cold-cathode electron emission can be achieved with a low level of drive voltage. In the following, an element formed as a combination of such a sharply pointed cathode member and an electron extraction electrode having an extraction aperture within which the tip of the cathode member is positioned, will be referred to as a field emission cathode. The microtip cathode member itself will be referred to simply as a cathode element.

Such a field emission cathode has the following advantages, in addition to low-voltage operation:

(1) A high level of current density is achieved.

(2) Since it is not necessary to heat the cathode, the power consumption is very low.

(3) The field emission cathode can be used as a point electron source.

In the prior art, such field emission cathodes have been utilized, arranged in high element-density arrays, for example to implement a flat panel fluorescent display. This is described in the publication "Displays", P. 37, January 1987.

Prior art methods of manufacture of such field emission cathodes will be described in the following. One method is shown in FIGS. 1A and 1B. Here, an electrically conductive layer 102, an electrically insulating layer 103 and an electrically conductive layer 104 are successively deposited on an electrically insulating substrate 101, and an array of cavities 105 are formed in these superposed layers by using appropriate masks during the deposition process. Rotational evaporative deposition is then performed to deposit a suitable cathode material 106, with this rotational deposition being simultaneously executed both in a vertical direction towards the substrate and obliquely to the substrate. This results in portions 107 being formed at the upper openings of the cavities 105, and gradually closing these openings, while at the same time pyramid-shaped portions 108 of the cathode material become formed upon the electrically conductive layer 102 within each cavity 105.

Lastly, as shown in FIG. 5B, the portions 107 are removed. This method is described in the Journal of Applied Physics, Vol 39, P. 3504, 1968.

Another prior art method will be described referring to FIGS. 2A to 2F. With this method, a plurality of rectangular substrates 121 formed of an electrically insulating material are first prepared, then a film of cathode material is formed upon one face of each substrate 121. A plurality of the resultant cathode material-formed substrates 123 are then successively stacked together in a multilayer manner as shown in FIG. 2A. The resultant multilayer block is then machined on its faces to obtain a multilayer substrate block 124. Next, as shown in FIG. 2B, a metal layer 125 is formed by evaporative deposition upon a major face of this block 124, then as shown in FIG. 2C, elongated slots 126, each having a length which is almost equal to the width of the block 124, are formed in the metallic layer 125 by photo-etching. These slots extend through the layer 125, to expose respective regions of the cathode material 122. The slots 126 serve as extraction electrode apertures. The cathode material-formed substrates 123 are then mutually separated, and as shown in FIG. 2D, etching is performed on the cathode material 122 of each cathode material-formed substrates 123, to form a pattern of sharply pointed triangular portions 127. Appropriate chemical erosion is then selectively applied to the substrate 121 of each of the cathode material-formed substrates 123, to remove specific portions of the substrate 121, such that portions adjacent to each tip of a cathode material-formed substrates 123 is removed while in addition a portion of the substrate 121 adjacent to each extraction electrode aperture 126 is also removed. The cavities 128 are thereby formed in each cathode material-formed substrates 123, as shown in FIG. 2(*e*). The cathode material-formed substrates 123 are then once more successively stacked together in the same arrangement as that prior to being separated, and are mutually attached, to thereby form an array of field emission cathodes This method is described in Japanese Patent Laid-open No. 54-17551.

However with the first of the above prior art methods, since it is necessary to execute rotational evaporative deposition of the cathode material both in a direction vertically above the cavities within which the microtip cathode elements are formed and also in an oblique direction, the manufacturing process is difficult.

In the case of the second of the above prior art methods, in order to attain a high precision of aligning the electron extraction aperture 126 and the cathode regions 122, it is necessary to achieve a very high accuracy for the thickness of the substrate 121 and the film thickness of the cathode material thin film 122. In addition, it is necessary to position the sections of the multilayer substrate block 124, when the block is finally re-assembled, in the respective mutual positions which the various sections had prior to being separated. However it is very difficult to achieve sufficient accuracy.

SUMMARY OF THE INVENTION

It is an objective of the present invention to provide a method of manufacture for field emission cathodes whereby a high level of manufacturing yield can be easily attained, by accurate mutual position alignment of microtip cathode elements and electron extraction apertures.

It is a further objective of the present invention to provide a field emission cathode whereby a high concentration of electric field can be easily achieved, and whereby the electron extraction efficiency can be high, and moreover whereby the withstanding voltage between a microtip cathode and a extraction electrode can be made high, while also providing high reliability.

To achieve the above objectives, with one manufacturing process according to the present invention, elongated parallel stripes of a layer of cathode material are formed on at least one electrically insulating substrate, another substrate is superposed on and attached to the first substrate, to sandwich the cathode material between the substrates, then the resultant block is sliced such as to obtain a plurality of blocks each having an array of exposed regions of cathode material on at least one face thereof. These exposed regions can then each be shaped to form a sharply pointed tip. Since the original cathode material layer can of course be made extremely thin and accurately formed, it becomes possible to form microtip cathodes having tips which are of extremely small size, with a high manufacturing yield.

Alternatively, it can be arranged that each strip of cathode material layer is enclosed within a layer of electrically insulating material, when sandwiched within such a superposed-layer block. After slicing, the resultant array substrate can be processed such as to leave a small portion of each cathode material layer portion protruding above the insulating material, as a microtip. Again, the dimensions of the cathode tip can be made extremely minute.

More specifically, one embodiment of a field emission cathode structure according to the present invention comprises:

a pair of electrically insulating substrates having at least respective upper faces thereof aligned in a common plane and with a gap formed between opposing side faces thereof;

a first metal layer formed within the gap, extending between the side faces;

a layer of electrically insulating material formed within the gap, extending between the side faces and in contact with a surface of the first metal layer, and having a surface thereof recessed below the common plane;

a layer of cathode material formed extending substantially parallel to the side faces and positioned centrally between the side faces, extending within the metal layer and insulating layer, and with one end thereof protruding from the recessed surface of the electrically insulating layer; and a second metal layer formed on the upper faces of the substrates, extending to the gap, to function as an electron extraction electrode.

Another embodiment of a field emission cathode structure according to the present invention comprises:

a pair of electrically insulating substrates having at least respective upper faces thereof aligned in a common plane and with a gap formed between opposing side faces thereof;

a layer of electrically insulating material formed within the gap, extending between the side faces, and having a surface thereof recessed below the common plane;

a layer of cathode material formed extending substantially parallel to the side faces and positioned centrally between the side faces, extending within the electrically insulating layer, with one end thereof protruding from the recessed surface of the insulating layer; and a second metal layer formed on the upper faces of the substrates, extending to the gap, to function as an electron extraction electrode.

One embodiment of a method of manufacture of field effect cathodes according to the present invention comprises successive steps of:

(a) forming a layer of cathode material upon a first face of a first electrically insulating substrate, the layer being patterned to form a plurality of elongated mutually parallel strip portions which are disposed at regular spacings;

(b) superposing a second electrically insulating substrate upon the first face of the first electrically insulating substrate, to sandwich the cathode material layer between the first and second electrically insulating substrates, and mutually attaching the first and second electrically insulating substrates, to obtain a superimposed substrate block;

(c) slicing the superimposed substrate block in at least one plane which is perpendicular to the substrate face and which traverses the set of cathode material strip portions, to thereby obtain at least one array substrate having exposed regions of the cathode material portions arrayed upon opposing faces thereof;

(d) selectively forming a first metal layer as mask portions, to cover only the exposed regions on one face of the array substrate;

(e) forming a second metal layer upon an upper face of each of the mask portions and upon regions of the array substrate surrounding the exposed cathode material regions; and (f) executing etching processing to remove the mask portions together with the second metal layer portions formed thereon, to thereby form apertures functioning as electron extraction apertures in the second metal layer surrounding respective ones of the exposed cathode material regions.

Another embodiment of a method of manufacture of field effect cathodes according to the present invention comprises successive steps of:

(a) forming a first metal layer upon a face of a substrate;

(b) forming a layer of a cathode material upon the first metal layer;

(c) forming a layer of photoresist to a predetermined thickness on the cathode material layer, and shaping the photoresist layer to a predetermined pattern by a photoetching process;

(d) executing etching to remove regions of the cathode material which are not covered by the photoresist, to thereby form a plurality of cathode material portions respectively protruding in a direction perpendicular to the face of the substrate;

(e) forming a first layer of an electrically insulating material to cover the first metal layer;

(f) selectively forming a second metal layer to cover only exposed side surfaces of the protruding cathode material portions;

(g) forming a second layer of electrically insulating material upon the first electrically insulating layer and respective upper surfaces of the photoresist mask portions;

(h) forming a third metal layer upon the second insulating layer;

(i) executing etching processing to remove the photoresist mask portions; and (j) executing etching processing to remove the second metal layer from the side surfaces of the protruding cathode material portions, to thereby form apertures functioning as electron extraction electrodes surrounding upper parts of respective ones of the protruding cathode material portions.

A third method of manufacture of field effect cathodes according to the present invention comprises successive steps of:

(a) forming a layer of a cathode material upon a major face of a substrate;

(b) forming a layer of photoresist to a predetermined thickness on the cathode material layer, and shaping the photoresist layer to a predetermined pattern by a photo-etching process;

(c) executing etching processing to remove regions of the cathode material which are not covered by the photoresist, to thereby form a plurality of cathode material portions respectively protruding in a direction perpendicular to the major face of the substrate;

(d) forming a first layer of an electrically insulating material upon upper surfaces of the photoresist portions and upon the cathode material layer, other than upon side surfaces of the protruding cathode material portions;

(e) forming a first metal layer over the side surfaces of the protruding cathode material portions;

(f) forming a second layer of electrically insulating material upon the first insulating layer and upper surfaces of the photoresist portions;

(g) executing processing to remove the photoresist;

(h) executing etching processing to remove the second metal layer from the protruding cathode material portions, to thereby form apertures in the second metal layer functioning as electron extraction apertures, surrounding upper parts of respective ones of the protruding cathode material portions.

A fourth method of manufacture of field effect cathodes according to the present invention comprises successive steps of:

(a) forming a first metal layer upon a face of a substrate;

(b) forming a first layer of photoresist upon the first metal layer, and shaping the photoresist layer to a predetermined pattern of mask portions by a photo-etching process;

(c) forming a first layer of electrically insulating material upon the first photoresist layer and upon exposed surfaces of the first metal layer;

(d) executing processing to remove the first photoresist layer;

(e) forming a layer of cathode material over the first insulating layer and exposed regions of the first metal layer;

(f) forming a second layer of photoresist upon the cathode material layer, and shaping the second photoresist layer to a second pattern of mask portions which is identical in shape and position to the first pattern of mask portions, by a photo-etching process;

(g) executing etching to remove exposed regions of the cathode material layer to a predetermined depth, to thereby form a plurality of cathode material portions respectively protruding in a direction perpendicular to the major face of the substrate;

(h) executing processing to remove the photoresist;

(i) forming a second layer of an electrically insulating material upon the first metal layer;

(j) forming a second metal layer over the protruding cathode material portions;

(k) forming a third electrically insulating layer over the second insulating layer and over the second metal layer formed on the protruding cathode material portions;

(l) forming a third metal layer over the third insulating layer; and (m) executing etching processing to remove the second metal layer from the protruding cathode material portions, to thereby form apertures in the third metal layer functioning as electron extraction apertures surrounding upper parts of respective ones of the protruding cathode material portions.

A fifth method of manufacture of field effect cathodes according to the present invention comprises successive steps of:

(a) forming a first metal layer upon a face of a first electrically insulating substrate;

(b) forming a layer of cathode material upon the first metal layer;

(c) forming a second metal layer upon the cathode material layer;

(d) superposing a second electrically insulating substrate upon the face of the first substrate, to sandwich the cathode material layer between the first and second electrically insulating substrates, and mutually attaching the first and second electrically insulating substrates to obtain a superimposed substrate block;

(e) slicing the superimposed substrate block in at least one plane which is perpendicular to the substrate face to thereby obtain at least one array substrate having on at least one face thereof; at least one exposed region of the cathode material layer enclosed by the metal layers (f) selectively forming a mask layer to cover only the exposed region on one face of the array substrate;

(g) forming a third metal layer upon an upper surface of the mask layer and upon a region of the array substrate surrounding the exposed region; and (h) executing processing to remove the mask layer together with the third metal layer portions formed thereon, to thereby form at least one aperture functioning as an electron extraction aperture in the third metal layer surrounding the exposed region;

(i) removing the first and second metal layers of the exposed region to a predetermined depth; and (j) forming a layer of electrically insulating material upon surfaces of the first and second metal layers within the exposed region.

A sixth method of manufacture of field effect cathodes according to the present invention comprises successive steps of:

(a) forming a first electrically insulating layer upon a face of a first electrically insulating substrate;

(b) forming a layer of cathode material upon the first metal layer;

(c) forming a second electrically insulating layer upon the cathode material layer;

(d) superposing a second electrically insulating substrate upon the face of the first substrate, to sandwich the cathode material and electrically insulating layer layers between the first and second electrically insulating substrates, and mutually attaching the first and second electrically insulating substrates to obtain a superimposed substrate block;

(e) slicing the superimposed substrate block in at least one plane which is perpendicular to the substrate face to thereby obtain at least one array substrate having, on at least one face thereof, at least one exposed region of the cathode material layer enclosed by the insulating layers;

(f) selectively forming a mask layer to cover only the exposed region on one face of the array substrate;

(g) forming a metal layer upon an upper surface of the mask layer and upon a region of the array substrate surrounding the exposed region; and (h) executing processing to remove the mask layer together with the metal layer formed thereon, to thereby leave a portion of the metal layer to function as an electron extraction electrode and to form at least one aperture functioning as an electron extraction aperture in the metal layer surrounding the exposed region; and (i) removing the first and second insulating layers of the exposed region to a predetermined depth, to leave one end of the cathode material layer protruding above a surface of the insulating layers.

BRIEF DESCRIPTION OF THE DRAWINGS

FIGS. 13(*f*) to (*k*) are cross-sectional views taken along the line II—II in FIG. 13(*e*);

FIGS. 17(*g*) to (*k*) are cross-sectional views taken along the line II—II in FIG. 17(*f*);

FIGS. 18(*a*) to (*c*) show a second example of a method of manufacture for the embodiment of FIG. 16.

DESCRIPTION OF PREFERRED EMBODIMENTS

Figure 1A:
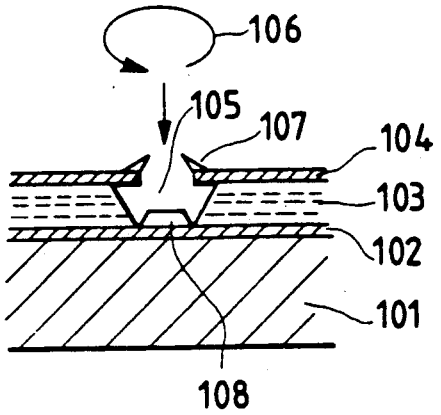
FIG. 1(a) PRIOR ART
FIGS. 1(*a*) to 1(*b*) and 2(*a*) to 2(*f*) are diagrams for illustrating steps of manufacture of a arrays of field emission cathodes according to methods of the prior art.
Figure 1B:
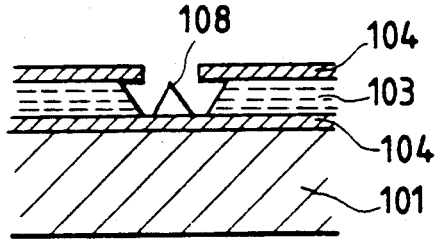
FIG. 1(b) PRIOR ART

Embodiments of methods of manufacture for field emission cathodes according to the present invention will be described in the following, referring first to FIGS. 3(*a*) to (*k*), which show successive manufacturing steps of a first embodiment for producing an array of field emission cathodes. As shown in FIG. 3(*a*), an electrically insulating substrate 1 formed of an electrically insulating material such as glass or alumina has the surfaces thereof machined to a sufficient degree of smoothnes. A film 2 of a material which is suitable for forming a field-emission cathode element (such a material being referred to in the following simply as a cathode material), such as tungsten, molybdenum, $BaB_6$, $CeB_6$, etc, is then formed over one face of the substrate 1, to a predetermined thickness (for example, 1 to 2 $\mu$m). Photo-etching processing is then executed, to form the cathode material layer 2 into a grid-shaped pattern 2', as shown in FIG. 3(*c*).

As shown in FIG. 5(*a*), the grid pattern of cathode material 2' mentioned above consists of vertically extending (as seen in the drawing) narrow stripe portions 2*a* of the cathode material and horizontally extending frame (i.e. wide stripe) portions 2*b*, with the portions 2*a* and 2*b* mutually intersecting such that a set of short stripe portions 2'*a* extend horizontally at fixed spacings between each pair of the frame portions 2*b*. The grid pattern 2' of cathode material can be considered to consist of successive repetitions in the vertical direction (as seen in FIG. 5(*a*)) of a unit pattern, consisting of such a set of short stripe portions 2'*a* disposed at fixed spacings between a pair of the frame portions 2*b*.

It is also possible to use other types of pattern for the cathode material layer 2'. For example as shown in FIG. 5(*b*), a tooth-shaped pattern can be formed, or as shown in FIG. 5(*c*) a pattern of parallel elongated stripes may be utilized. Alternatively as shown in FIG. 5(*d*), a "broken-line" pattern can be used.

With the tooth-shaped pattern of FIG. 5(*b*), elongated narrow stripe portions 2'*a* are disposed mutually parallel at fixed spacings, while a wide frame portion 2*b* mutually links these stripe portions 2'*a* along the lower ends of these portions 2'*c*.

With the stripe pattern of FIG. 5(*c*), a set of elongated stripe portions 2'*a* are disposed mutually parallel at fixed spacings. With the "broken-line" pattern of FIG. 5(*d*), unit patterns are successively formed each consisting of a set of short stripe portions 2'*a* which are arrayed at fixed spacings. The overall grid pattern of cathode material 2' consists of a plurality of these unit patterns, extending successively along the axial direction of the stripes, with the unit patterns being disposed at fixed spacings.

A number of cathode material-patterned substrates 3 are prepared, each of the cathode material-patterned substrates 3 being of the form shown in FIG. 3(*c*) with the cathode material layer formed into one of the above patterns. It will be assumed in this example that the grid pattern of FIG. 5(*a*) is utilized. Next, as shown in FIG. 3(*d*), these cathode material-patterned substrates 3 are successively superposed and mutually attached to form a single multilayer block 4, such that each patterned layer of cathode material 2' is sandwiched between two insulating substrates 1. The mutual attachment of the cathode material-patterned substrates 3 in this way can be accomplished in various ways, e.g. by a fusing method (i.e. by a welding operation), or by thermal adhesion using a material such as low melting-point glass frit, etc., in order to ensure that a field emission cathode array substrate (described hereinafter) will have sufficient solidity.

Next, as shown in FIG. 3(*d*), the superposed-substrate cathode block 4 is sliced into a plurality of sections, in a direction perpendicular to the planes of the substrates, along the chain-lines A, B, and C shown in FIG. 3(*d*) and shown also in the plan view of FIG. 5(*a*). These lines are positioned such as to cut transversely across respective ones of the sets of mutually parallel short stripe portions 2'*a* of the cathode material grid pattern, e.g. along directions as indicated by the lines B, C in FIG. 5(*a*). In addition, although not shown in FIG. 3(*d*), similar slicing is executed in the same direction, passing through the central axis of each of the frame portions 2'*b* of the cathode material grid pattern which is not positioned at an edge of the stacked-substrate cathode block 4, as indicated by the line B' in FIG. 5(*a*). The surfaces of the resultant block sections are then smoothed, by grinding, to obtain a set of array substrates 5, one of which is shown in FIG. 3(*e*).

As shown in FIG. 3(*e*), cathode material portions 2'' are thereby exposed, in an array configuration, on a surface S of the array substrate 5. This is the array pattern of the field emission cathodes. In each of the laterally extending sets of these cathode material portions 2'', as indicated in FIG. 3(*e*), the cathode material portions are mutually interconnected at the rear of the array substrate 5 by means of a frame portion 2*b*.

Next as shown in FIG. 3(*f*), a metallic layer 6 is selectively formed as a mask layer over the surface S, such as to cover only the exposed cathode material portions 2''. This metal layer pattern is formed by an electro-plating process.

A metal layer 7, used to form electron extraction electrodes as described hereinafter, is then formed over the mask metal layer portions 6 and the substrate surface S, as shown in FIG. 3(*g*). The mask portions 7' of metal layer which are upon the respective mask portions 6 on the cathode material regions 2'' are then removed by chemical etching removal of these mask portions 6, i.e. only the mask portions 6 and the portions of the metal layer 7 that are directly above respective mask portions are removed. In this way, as shown in FIG. 3(*h*), windows 8 are formed in the metal layer 7, for use as electron extraction apertures. In addition, the metal layer 7 is patterned to form respective electron extraction electrodes 7' for the field emission cathodes.

Next, as shown in FIG. 3(*j*), shaping of the exposed regions of the 2'' portions adjacent to the periphery of each electron extraction aperture 8 is executed, to form each of the 2'' portions, with a sharply pointed tip. This tip sharpening operation can be executed by electrolytic shaping, using a liquid electrolyte.

It is preferable that the metal layer 7 be formed of a material which has a high corrosion resistance with respect to the etching liquid used in the aforementioned chemical etching and the liquid electrolyte used in the electrolytic shaping, in order to ensure that satisfactory condition of the metal layer 7 is maintained during processing.

The field emission cathode array can be considered to be completed at the stage now reached, shown in FIG. 3(*j*). However as shown in FIG. 3(*k*), it is possible to then execute etching such as to selectively remove portions of the substrate 1 which are adjacent to each of the electron extraction apertures 8, to thereby form a mesa configuration, as shown in FIG. 3(*k*). This enables the withstanding voltage between the electron extraction electrodes 7' and the cathode material portions 2'' to be increased.

A second embodiment of a method of manufacture according to the present invention for producing an array of field emission cathodes will be described referring to FIGS. 4(*a*) to (*g*), which show successive basic steps in the process. This embodiment is substantially identical to the preceding embodiment, but differs in that the substrate 1 is formed of an optically transparent material, and in that the cathode material layer that is formed thereon is shaped into the stripe pattern shown in FIG. 5(*c*). As described above for the first embodiment, an array substrate 5 is obtained which has an array of cathode material portions 2'' which are exposed at a surface of the substrate. Next, as shown in FIG. 4(*a*), a layer of photoresist 9 is formed over a surface of the array substrate 5, covering the exposed cathode material portions 2'', to a uniform predetermined thickness, and is thermally dried. The photoresist layer 9 is then exposed to ultra-violet radiation 10, which is passed through the array substrate 5 from the rear face of the substrate. Thus, since the material of the array substrate 5 is optically transparent, the ultra-violet radiation 10 passes through all of the substrate other than the cathode material 2'' portions, so that all of the photoresist layer 9 other than those regions which are directly above the cathode material portions 2'' will be exposed to the ultra-violet radiation 10. The photoresist is then developed and these exposed portions removed, to leave a photoresist mask 9' formed on the cathode material portions 2''

Next, as shown in FIG. 4(*c*), a metal layer 7 is formed over the substrate surface and the mask portions 9', using a method such as metal plating or evaporative deposition. The mask portions 9' are then removed, together with portions 7'' of the metal layer 7 which had been formed upon these mask portions. As a result, electron extraction apertures 8 are formed, as shown in FIG. 4(*d*), while at the same time the metal layer 7 is formed into electron extraction electrodes 7', upon the upper face of the array substrate 5.

Next, the steps 4(*e*) and 4(*f*) are executed, whereby sharpening of the tips of the cathode elements (formed from the portions 2'') and formation of a mesa structure are achieved.

If it is required to mutually interconnect specific sets of the cathode elements (e.g. as is achieved with the preceding embodiment as shown in FIG. 3(*e*), then a further processing operation can be executed as shown in FIG. 4(*g*), whereby a metal layer 11 is formed on the rear face of the array substrate 5, and is patterned as required to interconnect these cathode elements.

Figure 6:
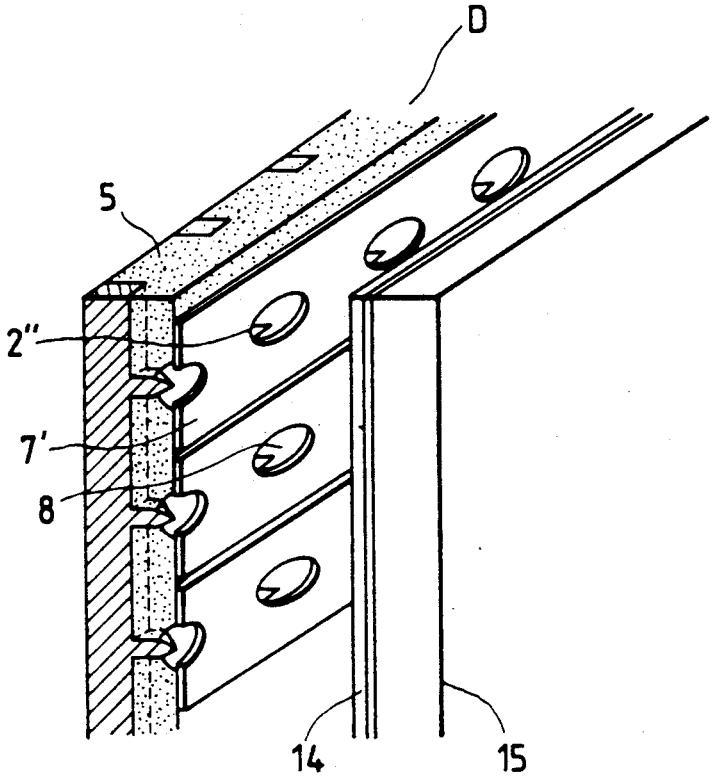
FIG. 6 is a partial oblique view of a practical example of a flat panel display device which incorporates an array of field effect cathodes manufactured according to the present invention.
Figure 2A:
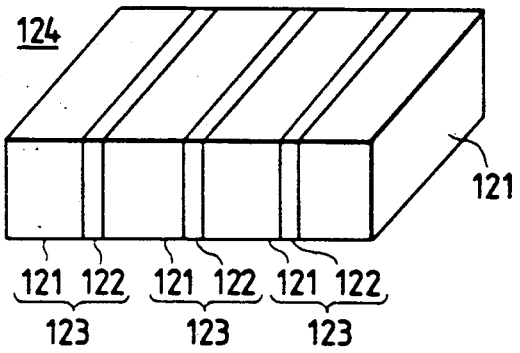
FIG. 2(a) PRIOR ART
Figure 2D:
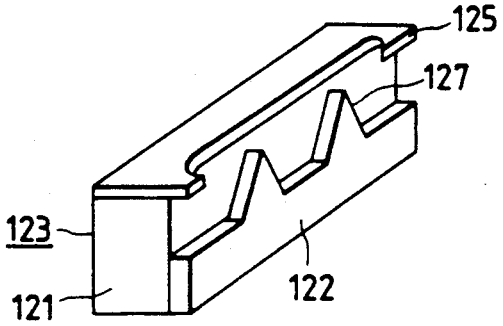
FIG. 2(d) PRIOR ART
Figure 2B:
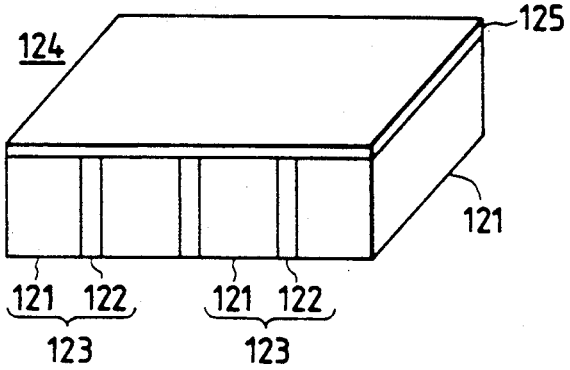
FIG. 2(b) PRIOR ART
Figure 2E:
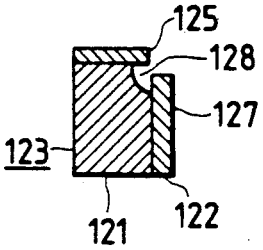
FIG. 2(e) PRIOR ART
Figure 2C:
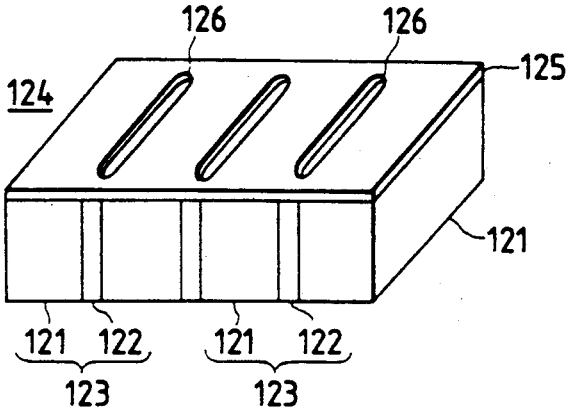
FIG. 2(c) PRIOR ART
Figure 2F:
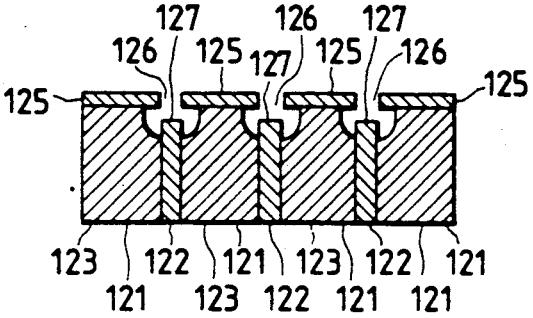
FIG. 2(f) PRIOR ART
Figure 3A:
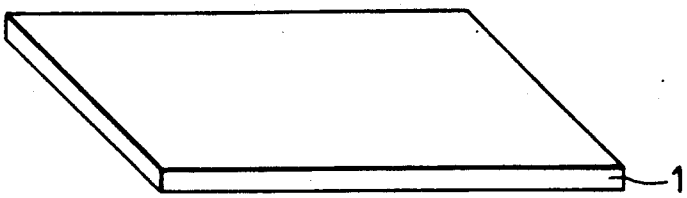
FIGS. 3(*a*) to (*k*) are diagrams for describing successive steps of a first embodiment of a method of manufacture according to the present invention for producing an array of field effect cathodes.
Figure 3B:
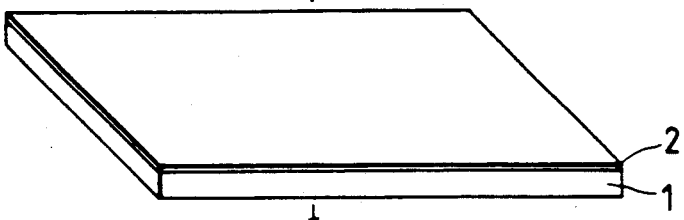
Figure 3C:
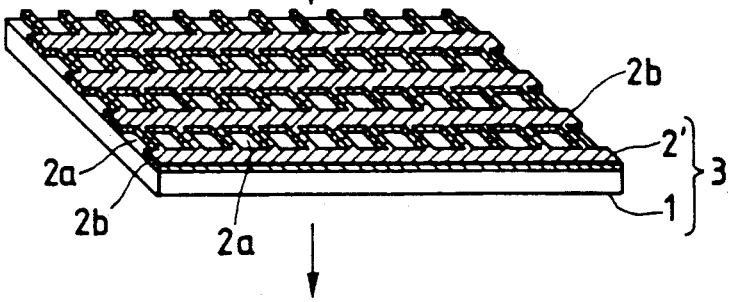
Figure 3D:
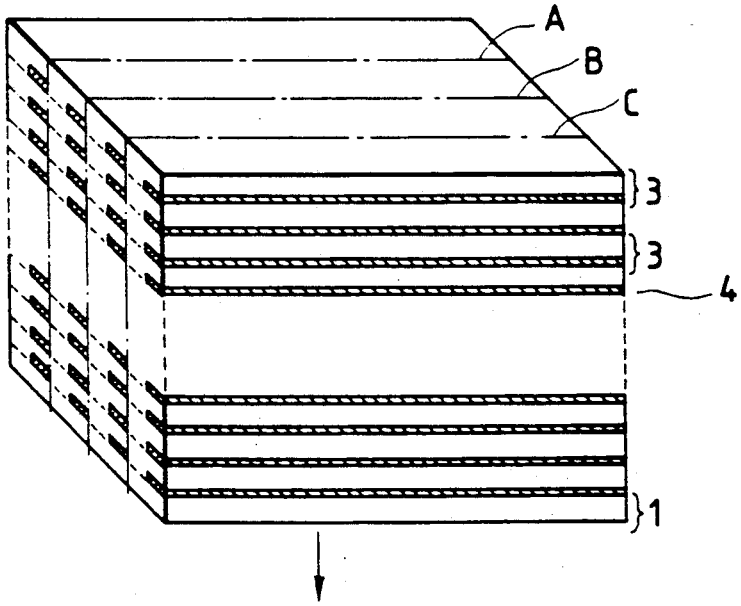
Figure 3E:
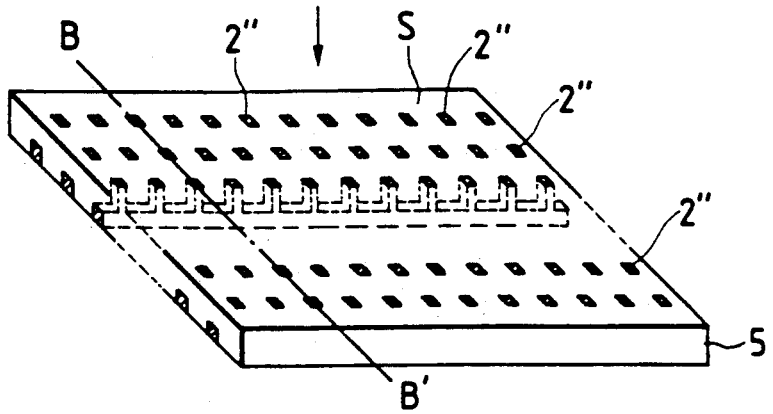
Figure 3F:
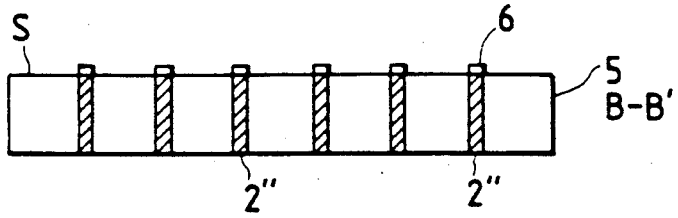
Figure 3G:
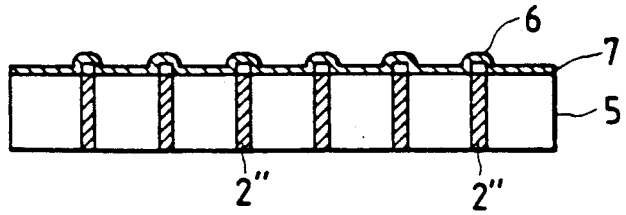
Figure 3H:
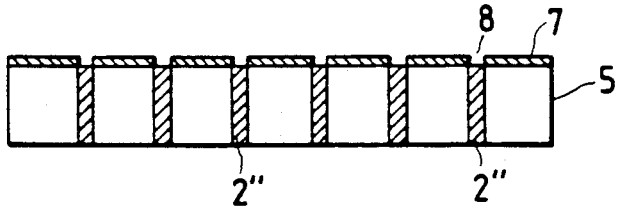
Figure 3J:
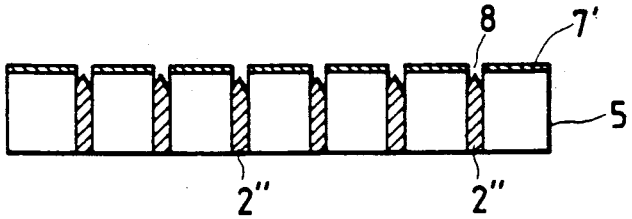
Figure 3K:
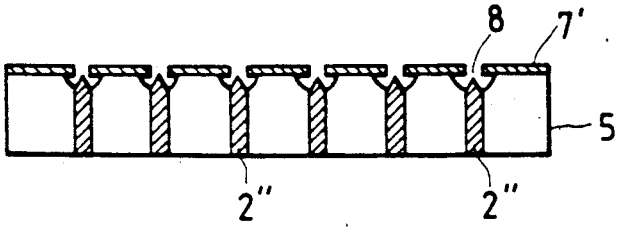
Figure 4A:
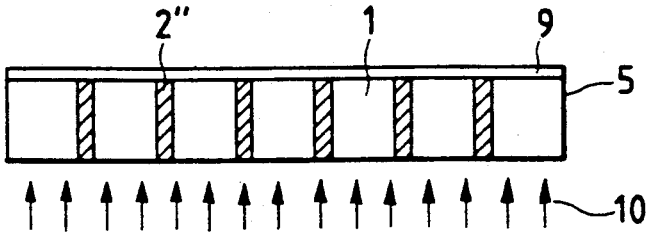
FIGS. 4(*a*) to (*g*) are diagrams for describing successive steps of a second embodiment of a method of manufacture according to the present invention for producing an array of field effect cathodes.
Figure 4B:
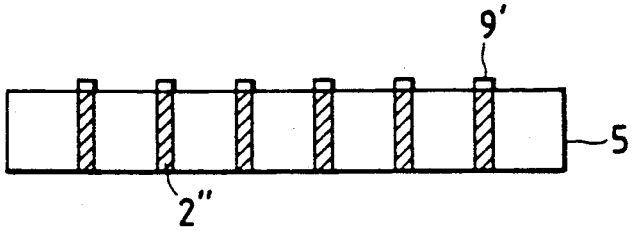
Figure 4C:
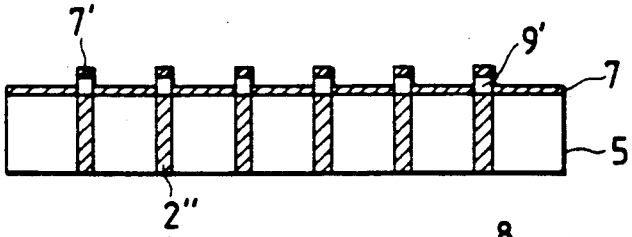
Figure 4D:
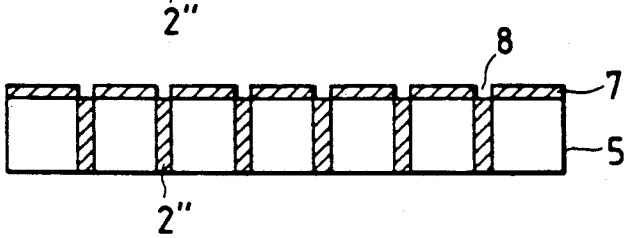
Figure 4E:
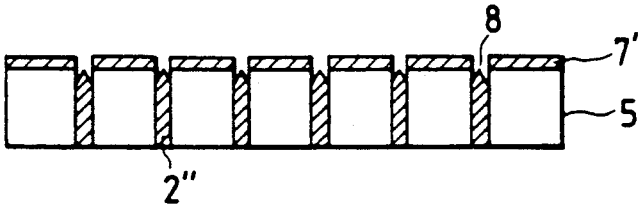
Figure 4F:
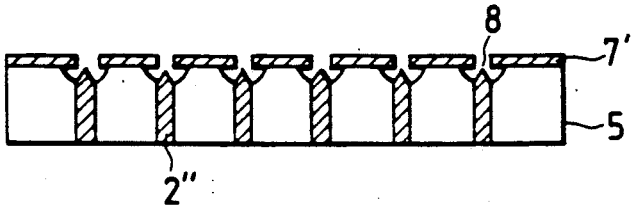
Figure 4G:
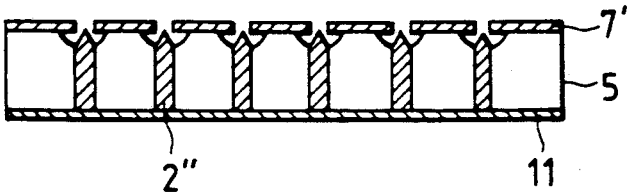
Figure 5A:
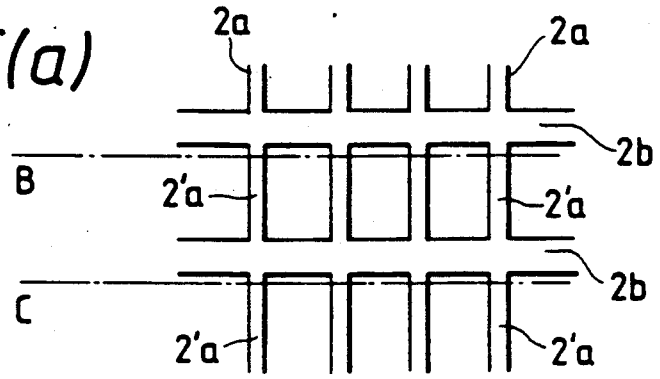
FIGS. 5(*a*) to (*d*) are partial plan views showing three examples of patterns for a cathode material layer in the first or second method embodiments.
Figure 5B:
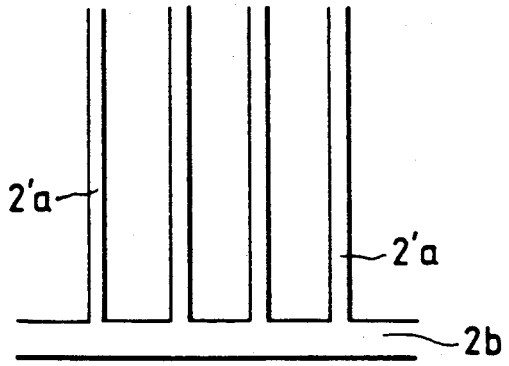
Figure 5C:
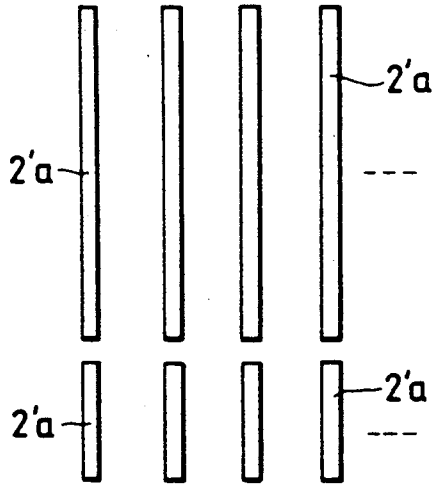
Figure 5D:
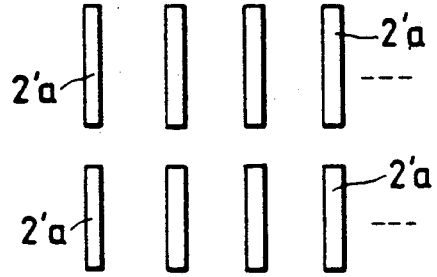
Figure 7A:
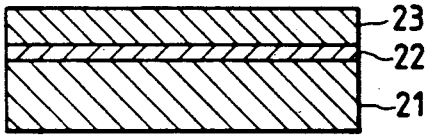
FIG. 7(*a*) to (*f*) are partial cross-sectional views for describing successive steps of a third embodiment of a method of manufacture according to the present invention for producing an array of field effect cathodes.
Figure 8A:
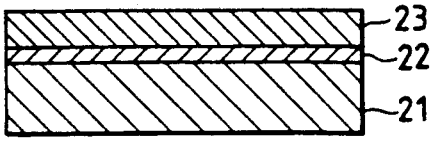
FIGS. 8(*a*) to (*f*) are partial cross-sectional views for describing successive steps of a fourth embodiment of a method of manufacture according to the present invention for producing an array of field effect cathodes.
Figure 7B:
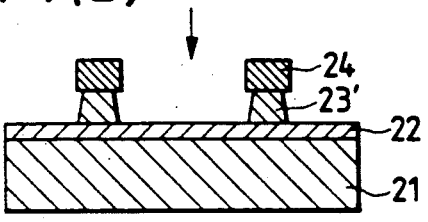
Figure 8B:
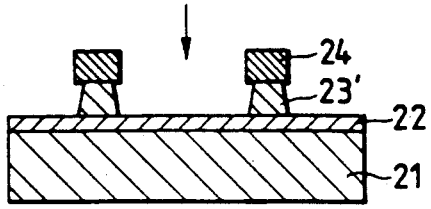
Figure 7C:
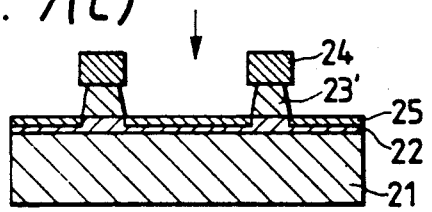
Figure 8C:
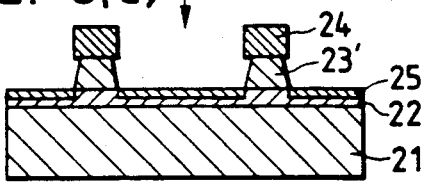
Figure 7D:
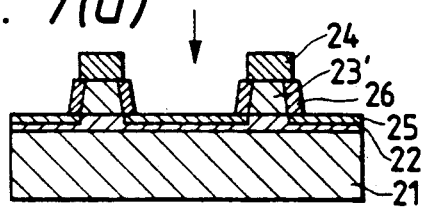
Figure 8D:
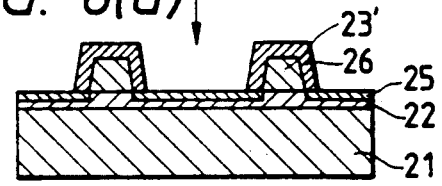
Figure 7E:
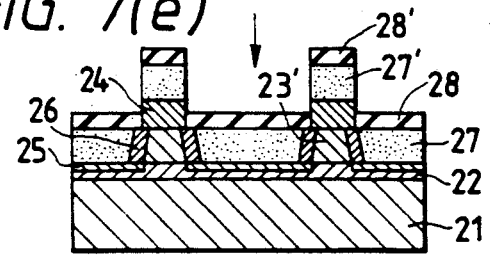
Figure 8E:
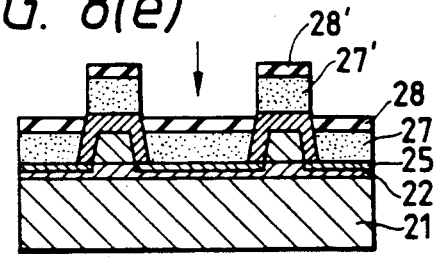
Figure 7F:
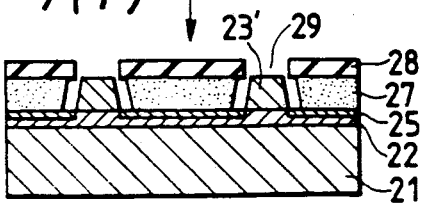
Figure 8F:
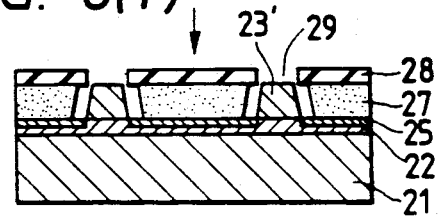
Figure 9A:
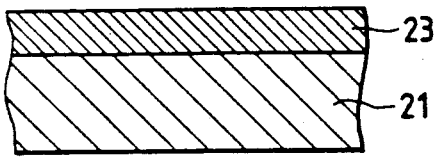
FIGS. 9(*a*) to (*e*) are partial cross-sectional views for describing successive steps of a fifth embodiment of a method of manufacture according to the present invention for producing an array of field effect cathodes.
Figure 9B:
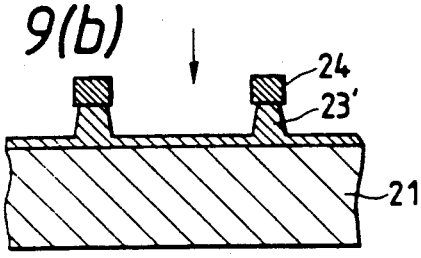
Figure 9C:
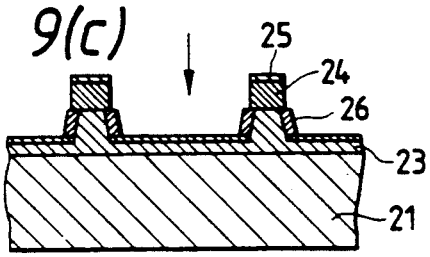
Figure 9D:
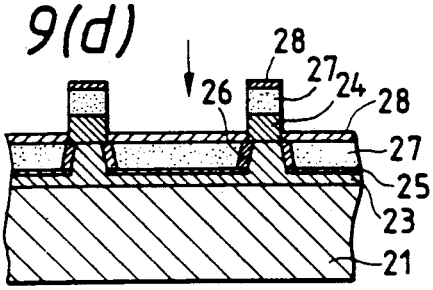
Figure 9E:
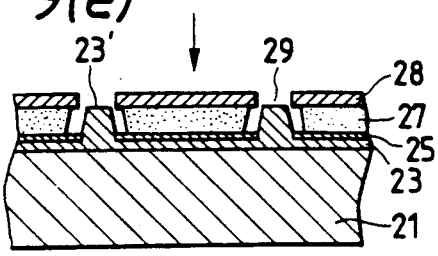
Figure 10A:
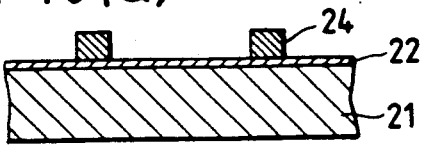
FIGS. 10(*a*) to (*d*) are partial cross-sectional views for describing successive steps of a fifth embodiment of a method of manufacture according to the present invention for producing an array of field effect cathodes.
Figure 10B:
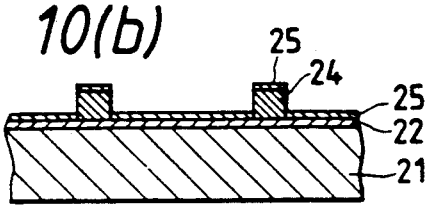
Figure 10C:
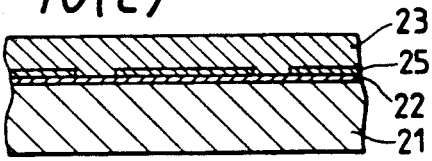
Figure 10D:
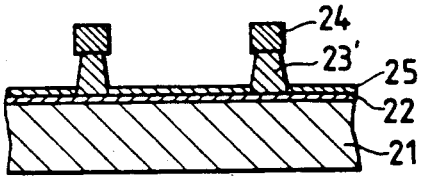
Figure 11:
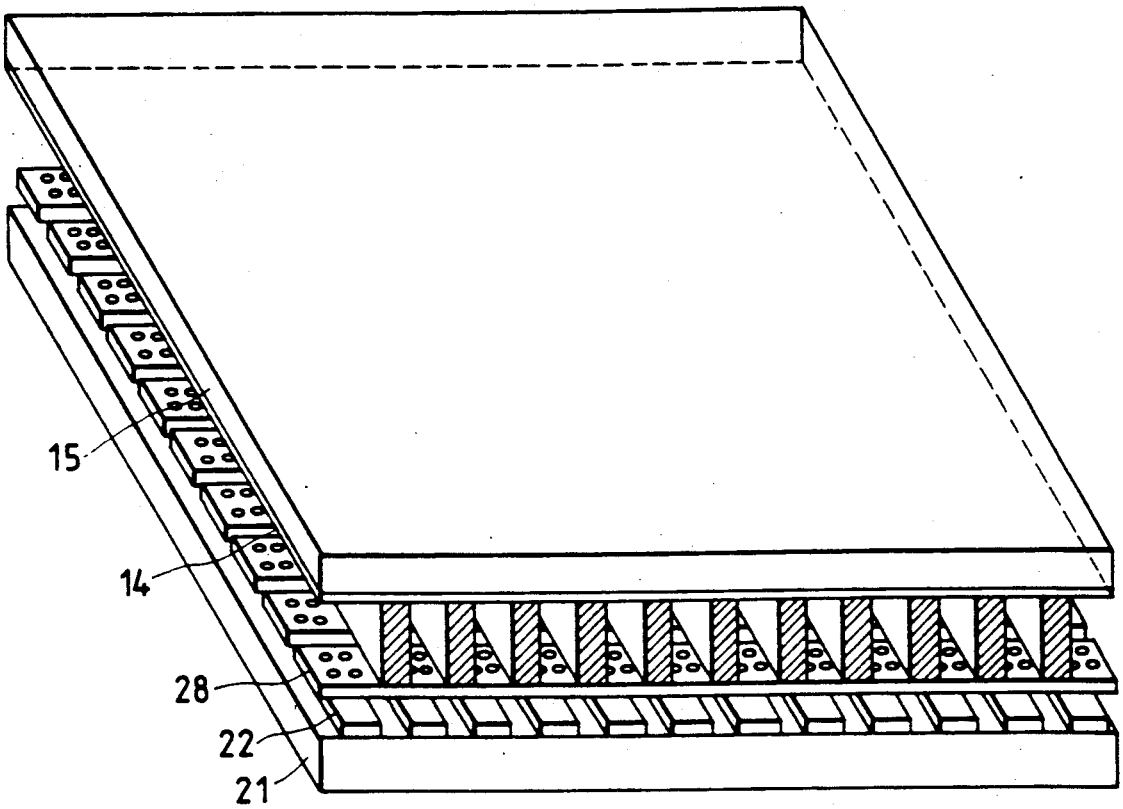
FIG. 11 is an oblique view of a practical example of a flat panel display unit which incorporates an array of field effect cathodes manufactured according to a method of the present invention.

FIG. 6 is a partial oblique view of a flat fluorescent display panel that is formed by combining a field emission cathode array manufactured by a method according to the present invention (in this example, by the first method according to the present invention described above) with a transparent faceplate 15 having a photoemissive layer 14 formed on the inner face thereof.

Both of the above embodiments of methods of manufacture according to the present invention have been described for the case of a 2-dimensional array of field emission cathodes being produced. However each embodiment could also be applied to the production of a one-dimensional array. In that case, it is only necessary to use two of the electrically insulating substrates, sandwiching a single patterned layer of cathode material, to form a layered block 4. That is, only a single substrate having a patterned cathode material layer is first formed, then an electrically insulating substrate without a cathode material layer is adheringly mounted upon the patterned cathode material layer. Alternatively, it is possible to adhesively mutually superpose two electrically insulating substrates each having a patterned cathode material layer formed thereon, with the substrates being combined such that the patterned portions of each substrate are brought together.

Moreover it is possible to form a 2-dimensional array by combining a plurality of one-dimensional arrays.

With the embodiments of methods of manufacture according to the present invention described above, it becomes possible to easily achieve a very high degree of accuracy of alignment of the electron extraction apertures with the tips of the cathode elements.

FIGS. 7(*a*) to (*f*) are partial cross-sectional views showing successive steps in a third embodiment of a method of manufacture according to the present invention for producing an array of field effect cathodes. Firstly as shown in FIG. 7(*a*), an electrically insulating substrate 21 formed of a material such as glass or alumina, has surfaces thereof ground to a high degree of flatness, and a metal layer 22 formed thereon to a predetermined thickness (e.g. 2000 to 3000 Å). The metal layer 22 is preferably formed of a material such as aluminum or titanium, which can be easily oxidized on a surface thereof during a subsequent processing step, in order to form an electrically insulating layer thereon by chemical reaction. A layer of cathode material 23 formed of a substance such as W, Mo or $BaB_6$ is then formed upon the metal layer 22 to a predetermined thickness, e.g. to 1 to 2 μm.

Next as shown in FIG. 7(*b*), a photoresist layer 24 is formed over the cathode material 23, and patterned in a predetermined array configuration. Etching of the cathode material 23 is then executed to form upwardly protruding cathode material portions 23', each covered by a portion of the photoresist 24 in a mesa configuration. Next, as shown in FIG. 7(*c*), exposed regions of the metal layer 22 are converted to an electrically insulating layer 25 by a process such as oxidation. For example if the metal layer 22 is formed of a metal such as Al or Ta, then an electrically insulating layer 25 of metal oxide can be easily formed (i.e. as $Al_2O_3$ or $Ta_2O_5$), by the usual anodic oxidation process.

In the succeeding processing, as shown in FIG. 7(*d*), the exposed surfaces (i.e. not covered with the photoresist) of the portions 23' are covered with a metal layer 26, by electroplating processing, to a predetermined thickness, e.g. to approximately 1 μm. This metal layer 26 is subsequently removed by etching, using an etching liquid, to thereby execute shaping of electron extraction apertures of electron extraction electrodes formed by a metal layer 28 (described hereinafter). The metal layer 28 is formed of a metal which is not substantially affected by this etching liquid.

Next, as shown in FIG. 7(*e*), an electrically insulating layer 27 formed of a material such as $Al_2O_3$, or $SiO_2$, is formed by a process such as vacuum evaporative deposition upon the metal layer 25 and the photoresist portions 24, to a thickness which is substantially identical to that of the cathode material 23 (i.e. the thickness of the original layer 23 shown in FIG. 7(*a*)). In addition, a metal layer 28 is formed by a process such as evaporative deposition upon the insulating layer 27, to a predetermined thickness, as a layer for use in forming the electron extraction electrodes.

Upon completion of the above processing, the photoresist 24 is removed. The insulating layer 27 and the metal layer 28 which are on the photoresist portions 24 are thereby removed at the same time as the photoresist 24. As a result, the upper surface of each of the electroplated metal layer portions 26 become exposed, and etching is then executed to remove the metal layer 26, by using the aforementioned etching liquid. Thus, as shown in FIG. 7(*f*), electron extraction apertures 29 are formed around the tops of the upwardly protruding cathode material portions 23'. In this way, a field emission cathode array is formed, having an electron extraction layer (metal layer) 28 which has electron extraction apertures formed therein, appropriately positioned with respect to the upper ends of the protruding cathode material portions 23'.

In this field emission cathode array, the side surface of each of the cathode material layer 23 portions is spaced apart from the insulating layer 27 by a fixed amount, and is substantially identical in height to the thickness of the insulating layer 27. A low level of leakage current can thereby be ensured.

A fourth embodiment of a method of manufacture according to the present invention for producing an array of field effect cathodes will be described referring to FIGS. 8(*a*) to (*f*), which are partial cross-sectional views showing successive steps in the processing. With this embodiment, as shown in FIGS. 8(*a*) to (*c*), substantially identical processing steps to those of FIGS. 7(*a*) to (*c*) of the preceding embodiment are executed. Thereafter, the photoresist portions 24 on the cathode material 23 are removed, then a metal layer 26 is formed over the upwardly protruding cathode material portions 23'. Next, as shown in FIG. 8(*e*), an electrically insulating layer 27 and a metal layer 28 are successively formed over the insulating layer 25 and the metal layer 26. Etching removal of the metal layer 26 is then executed, to leave an array of field effect cathodes as shown in FIG. 7(*f*) which is provided with a metal layer 28 functioning as an electron extraction electrode, having electron extraction apertures 29 formed therein, each containing the upper part of an upwardly protruding cathode material portion 23'.

A fifth embodiment of a method of manufacture according to the present invention for producing an array of field effect cathodes will be described referring to FIGS. 9(*a*) to (*e*), which are partial cross-sectional views showing successive steps in the processing. Firstly as shown in FIG. 9(*a*), a layer of cathode material 23 is formed over an electrically insulating substrate 21 to a uniform predetermined thickness (for example, 2 to 3 μm). Next, as shown in FIG. 9(*b*), a patterned photoresist layer 24 is formed upon the cathode material 23 in a predetermined array pattern, and the cathode material 23 is then etched to a fixed depth (e.g. 1 to 2 μm), to thereby form upwardly protruding portions of the cathode material 23' below respective ones of the photoresist portions 24, with a mesa configuration. Next, as shown in FIG. 9(*c*), an electrically insulating layer 25 is formed by evaporative deposition to a thickness of approximately 1000 Å to 2000 Å, over the remaining expose horizontal surface of the cathode material 23 and the upper face of each photoresist 24 portion. The insulating layer 25 is preferably a material such as $AlO_2$ or $SiO_2$. Next, the array pattern of upwardly protruding portions of the cathode material 23' has a metal layer 26 formed thereon by electroplating. Thereafter, as shown in FIG. 9(*d*) and in the same way as for the third embodiment described above, the insulating layer 27 and the metal layer 28 are successively formed on top of the insulating layer 25 and the photoresist layer portions 24. The photoresist 24 is then removed, thereby also removing at the same time the portions of insulating layer 27 and metal layer 28 which are superposed on the photoresist 24. The metal layer 26 is then removed by etching, to form apertures which constitute the electron extraction apertures 29, leaving the array of field effect cathodes as shown in FIG. 9(*e*).

A sixth embodiment of a method of manufacture according to the present invention for producing an array of field effect cathodes will be described referring to FIGS. 10(*a*) to (*d*), which are partial cross-sectional views showing successive steps in the processing. With this embodiment, the steps in the manufacturing process up to the step 10(*a*) are identical to the the steps of FIG. 7(*a*) to 7(*c*) for the third embodiment described above, so that further description of these is omitted. Only the steps which differ from those of the third embodiment will be described.

As shown in FIG. 10(*a*), a metal layer 22 is formed over one face of an electrically insulating layer 21, to a predetermined thickness, by a process such as evaporative deposition. A pattern of photoresist 24 is then formed upon the metal layer 22, for use as a photo-mask when forming an array pattern for the field emission cathodes. Next as shown in FIG. 10(*b*), an electrically insulating layer 25 (formed of a material such as $Al_2O_2$, or $SiO_2$) is formed to a thickness of approximately 1000 Å, by a process such as vacuum evaporative deposition, over the upper faces of the photoresist 24 portions and the metal layer 22. The photoresist 24 is then removed. Next, as shown in FIG. 10(*c*), a layer of cathode material 23 is formed over the exposed regions of the metal layer 22 and the insulating layer 25, to a predetermined thickness (e.g. 1 to 2 μm). A pattern of photoresist 24 is then once more formed, upon the cathode material 23, using the same photoresist mask as that used to form the photoresist pattern of FIG. 10(*a*). The portions of the cathode material layer 23 that are not covered by portions of the photoresist 24 pattern are then removed by etching, leaving an array of upwardly protruding portions 23' of the cathode material, each disposed below a photoresist 24 portion and having a mesa shape, as seen in cross-sectional view. In this condition, the array of upwardly protruding cathode material portions 23' are in direct contact with the metal layer 22.

Thereafter, as shown in FIGS. 7(*d*) to (*f*), or in FIGS. 8(*c*) to (*f*), processing steps are executed to complete the formation of the array of field effect cathodes.

Figure 15:
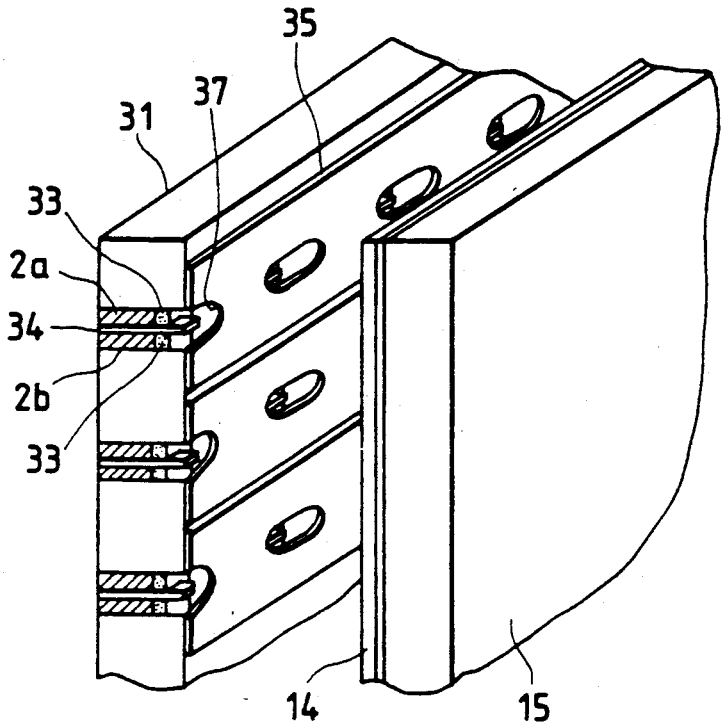
FIG. 15 is a partial oblique view of an example of a flat panel display unit which incorporates an array of field effect cathodes manufactured according to a method of the present invention.

With an array of field emission cathodes manufactured by the methods of the third through sixth embodiments of the present invention described above, it becomes possible to produce a flat panel display as shown in FIG. 15, by combining such an array with a transparent substrate having a layer of photo-emissive material 14 formed on an inner face thereof.

In the method of manufacture embodiments described above, an electrically insulating substrate 21 is utilized which is formed of an electrically insulating material. However it would be equally possible to use a substrate formed of a metal. In that case, it would be necessary to drive the resepective field emission cathodes mutually independently. This can be done by forming portions of the metal layer 28 as respectively separate electron extraction electrodes for these field emission cathodes. It should also be noted that the embodiments described above are not limited to the formation of the upwardly protruding cathode material portions 23' with the tip shapes that are shown in the drawings. Moreover with the third and fourth embodiments, it would be possible to form the insulating layer 25 upon the metal layer 22 by using a material that is different from that of layer 22. In addition, with the sixth embodiment, it would be possible to form the insulating layer 25 on the surface of the metal layer 22 by oxidation.

With the third to sixth embodiments of a method of manufacture according to the present invention described above, a metal layer is formed on surfaces of an array of upwardly protruding portions of a cathode material, and after an electrically insulating layer and a metal layer for constituting electron extraction electrodes have been successively deposited, the metal layer portions which are on the surfaces of the cathode material are removed, to form electron extraction apertures and separation gaps surrounding the cathode material portions 23'. This ensures highly accurate alignment of the upwardly protruding cathode material portions 23' and the electron extraction apertures of the electron extraction electrodes, so that these methods of manufacture enable highly accurate field effect cathodes to be manufactured with a high manufacturing yield.

Figure 12:
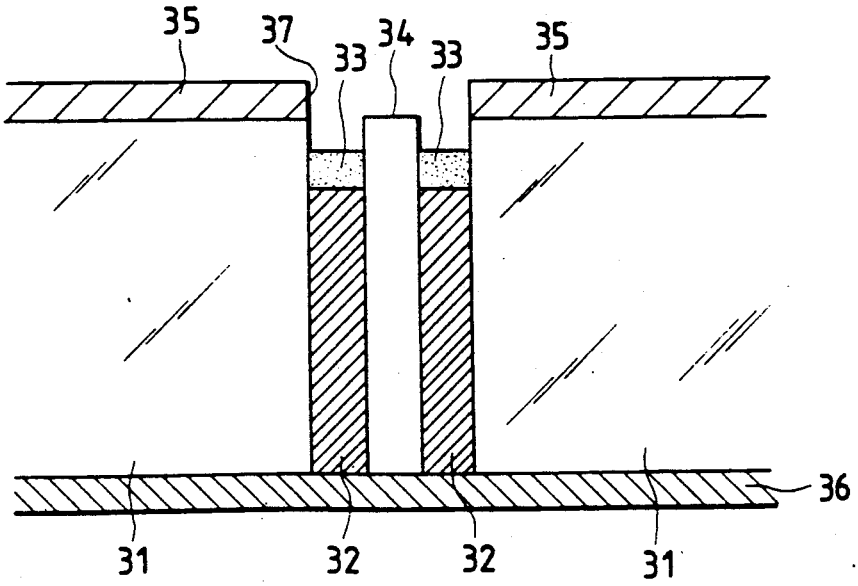
FIG. 12 is a partial cross-sectional view of an embodiment of a field emission cathode according to the present invention.
Figures 13A, 13B, 13C, 13D:
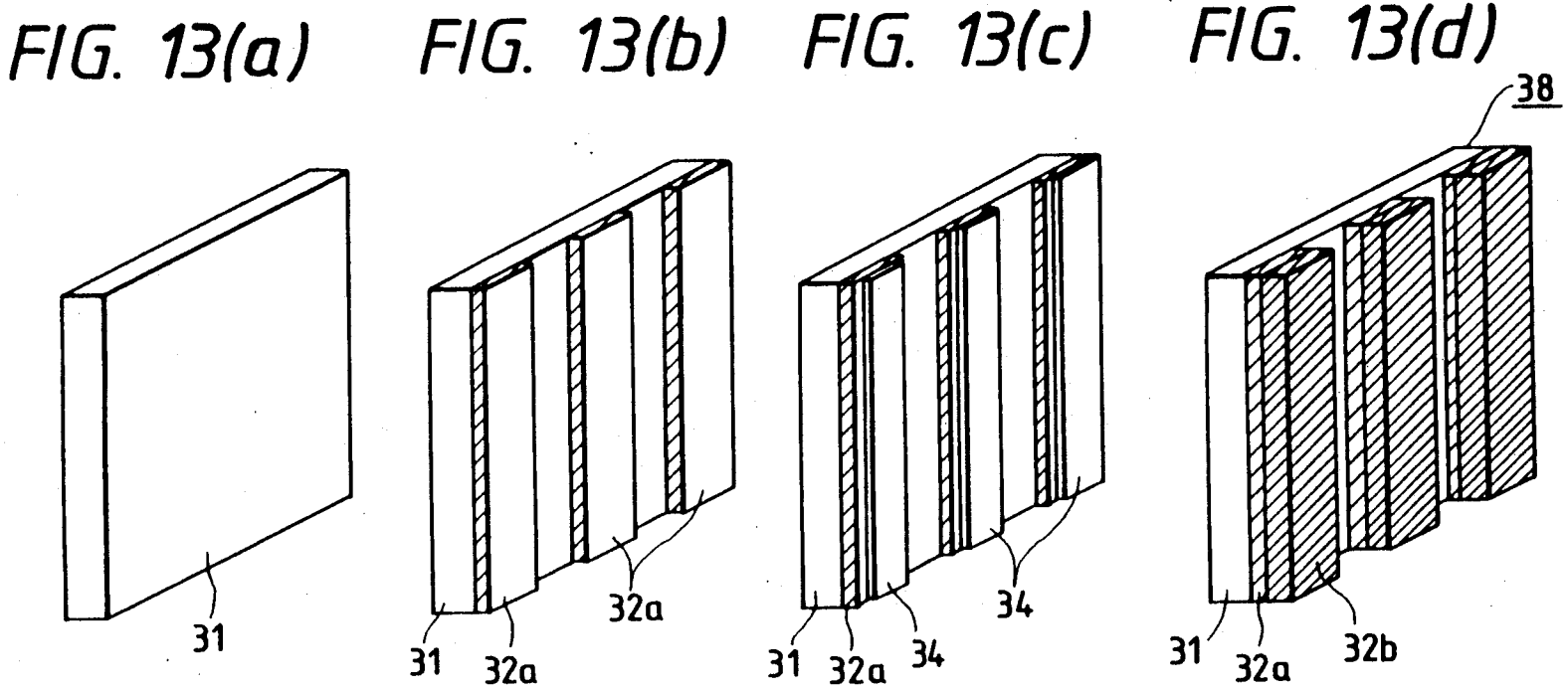
FIGS. 13(*a*) to (*e*) are oblique views to illustrate a method of manufacture for the embodiment of FIG. 12.
Figure 13E:
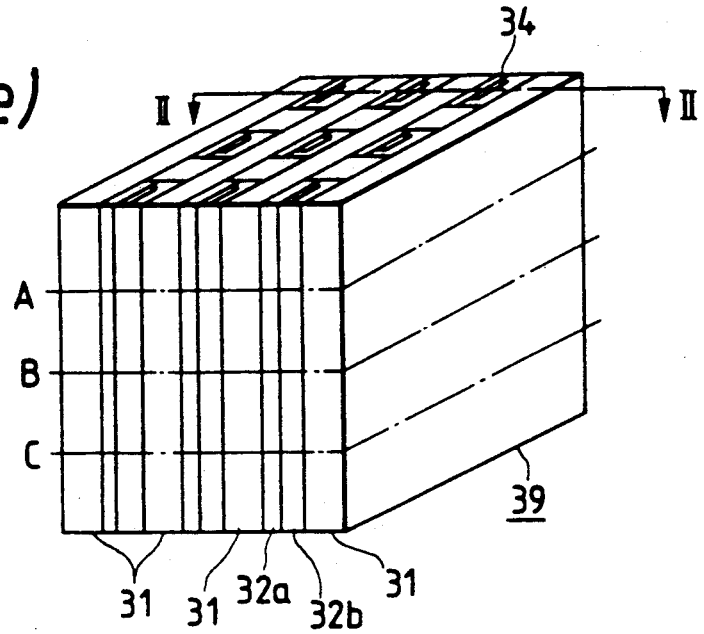
Figure 13F:
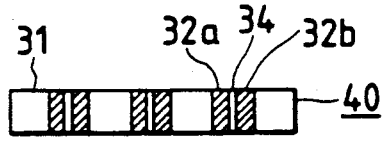
Figure 13G:
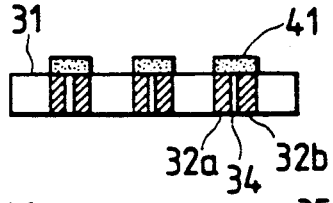
Figure 13H:
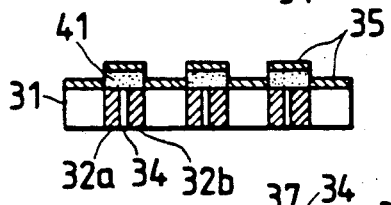
Figure 13I:
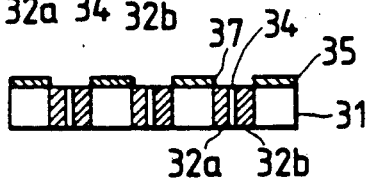
Figure 13J:
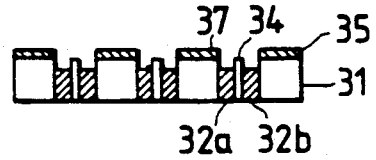
Figure 13K:
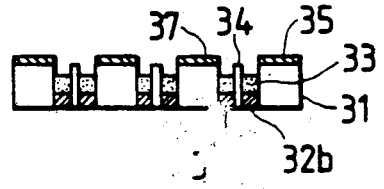

FIG. 12 is a partial cross-sectional view of an embodiment of a field emission cathode according to the present invention. In FIG. 12, between two opposing vertical (as viewed in the drawing) faces of electrically insulating substrates 31 formed of a material such as glass or ceramic is formed a layer 32 of a metal such as Al, or Ta, with a layer of electrically insulating material 33 vertically superposed thereon as shown. In the center of these layers 32 and 33 is formed a portion of a layer of cathode material 34 (formed of a material such as W, Mo, TiC, SiC, ZrC, or $LaB_6$) extending through the layers 32 and 33, elongated in a direction parallel to the aforementioned opposing substrate faces. The configuration of such a field emission cathode can be clearly understood from FIG. 15, which is an oblique view of a field emission cathode array used in a flat panel display unit. The upper surface of the insulating layer 33 is made lower than an upper surface of the substrates 31. The top surface of the cathode material layer portion 34 extends above the insulating layer 33, to be at substantially the same height as the upper surface of the substrates 31. The the thickness of the portion 34 (as measured in a direction extending between the aforementioned vertical faces of the substrates 31) is made approximately 100 Å to 1 μm. The upper face of the substrates 31 has a patterned metal layer 35 formed thereon, constituting an electron extraction electrode for the field emission cathode. This metal layer is formed of a material such as Mo or Ta.

If necessary, a patterned electrically conductive layer 36 can be formed on the opposite face of the substrate 31 to that on which the metal layer 35 is formed, with the layer 36 being in electrical contact with the cathode material 34.

With this embodiment, due to the fact that the dimensions of the tip of the cathode material layer 34 can be made extremely small, a high concentration of electric field can be easily achieved. Thus highly effective extraction of electrons through the electron extraction aperture 37 can be obtained, even with only a low level of voltage being applied between the cathode material layer 34 and the electron extraction electrode 35. Furthermore, due to the fact that a gap and also the insulating layer 33 are disposed between the cathode material layer 34 and the metal layer 35, a high value of withstanding voltage between these, so that high reliability is attained.

Figures 14A, 14B, 14C, 14D:
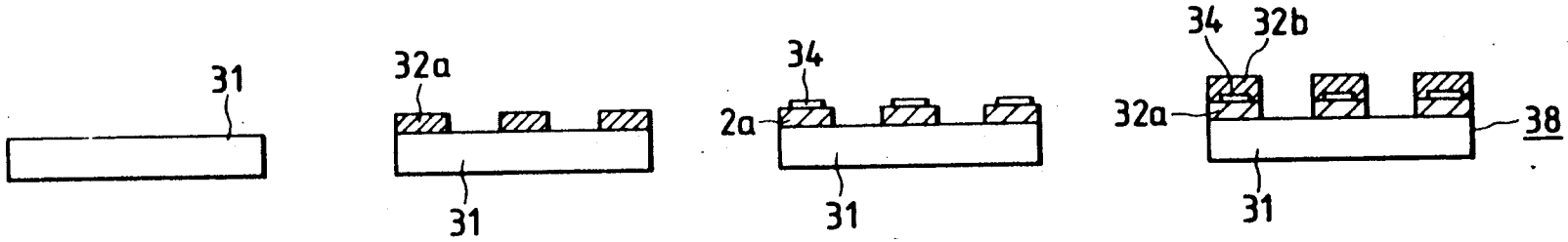
FIGS. 14(*a*) to (*d*) are plan views of FIGS. 13(*a*) to (*d*)

A method of manufacture for this embodiment will be described in the following. FIGS. 13(*a*) to (*k*) show steps in this method. FIGS. 13(*a*) to (*e*) are partial oblique views illustrating manufacturing steps. FIGS. 13(*f*) to (*k*) are partial cross-sectional views taken along line II—II in FIG. 13(*e*), showing remaining steps in the manufacturing process. FIGS. 14(*a*) to (*d*) are partial plan cross-sectional views corresponding to the steps of FIGS. 13(*a*) to (*d*).

The manufacturing process is as follows. Firstly, as shown in FIGS. 13(*a*) and 14(*a*), an electrically insulating substrate 31 is formed from a material such as glass or alumina, and machined to a sufficient degree of flatness on surfaces thereof. Next as shown in FIGS. 13(*b*), 14(*b*), a pattern of mutually parallel stripe portions of a first metal layer 32*a* (formed of a metal which can be readily oxidized to form an electrically insulating layer thereon, such as Al or Ta) are formed to a predetermined thickness (for example 0.5 to 1 μm), on one face of the substrate 31. This stripe pattern of the first metal layer 32*a* is formed by a process such as evaporative deposition through a mask, or forming a metal layer over the entire surface of the substrate 31 by evaporative deposition or sputtering deposition, then executing photo-etching of the metal layer to form the stripe pattern. It should be noted that the embodiment is not limited to the use of such a stripe pattern for the first metal layer 32*a*, and that it would be equally possible to use some other suitable pattern, e.g. a grid pattern or a tooth pattern, etc, as shown in FIGS. 5(*a*) and 5(*b*). The pattern is selected in accordance with specific requirements.

Next, as shown in FIGS. 13(*c*), 14(*c*), a layer of cathode material 34 consisting of a substance such as W, Mo, Ti C, Si C, is formed over each of the stripe portions of the first metal layer 32*a*, by a process such as mask evaporative deposition or CVD to a predetermined thickness (e.g. 100 Å to 1 μm. The width of each cathode material layer 34 on each stripe portion of the first metal layer 32*a* is made identical to or slightly less than the width of the first metal layer 32*a* stripe.

Next, as shown in FIGS. 13(*d*), 14(*d*), stripe portions of a second metal layer 32*b* each of identical width to the stripes formed of the first metal layer 32*a* are respectively formed on each of the cathode material layer 34 stripes. The second metal layer 32*b* consists of the same material as the first metal layer 32*a*.

A composite substrate 38 is thereby formed. A plurality of these composite substrates 38 are manufactured, and are then successively stacked together and mutually attached to form a single superposed-substrate block 39 as shown in FIG. 13(*e*). This superposition is executed such that each of the tri-layer combinations of a first metal layer 32*a*, cathode material layer 34 and second metal layer 32*b* is sandwiched between two of the substrates 31. In this superposing operation, surfaces that are brought into contact are made to mutually adhere, by utilizing a deposited adhesive material, or by thermal adhesion using a low melting-point glass frit, or by using a thermally resistant adhesive material. The substrates are thereby formed into a strongly solid block 39, which ensures that sufficient strength will be obtained in array substrates 40 that are produced as described hereinafter.

Next, the block 39 is sliced along the lines A, B, C shown in FIG. 13(*e*), such as to transversely cut through the stripe portions of cathode material layer 34, perpendicular to the direction of elongation of these stripe portions. The resultant sections formed from the block 39 are then mechanically polished to thereby obtain the array substrates 40, one of which is shown in partial cross-sectional view in FIG. 13(*f*). This array substrate 40 has an array of of cathode material layer 34 portions, which defines the field emission cathode array pattern, with exposed regions of these cathode material layer 34 portions appearing on each of opposing faces of the substrate. Each of these cathode material layer 34 portions is enclosed between metal layer 32*a* and 32*b* portions.

Next as shown in FIG. 13(*g*), a pattern of a metal layer 41 is formed as a mask pattern on the array substrate 40, with respective portions of the metal layer 41 covering only the exposed regions of the cathode material layer 34 and metal layers 32*a*, 32*b* on one side of the substrate 40, to a predetermined thickness. Alternatively, if the substrate 31 is formed of an optically transparent material, a pattern of photoresist can be utilized to form this mask. In that case, a layer of photoresist is first coated over one face of the array substrate 40, then the opposite face of the substrate 40 is illuminated with ultraviolet radiation, and the portions of the photoresist that have been exposed to the radiation then developed and removed, to leave mask portions corresponding to the metal layer portions 41 of FIG. 13(*g*).

After the mask portions have thus been formed, then as shown in FIG. 13(*h*), a patterned metal layer 35 consisting of a material such as W, Mo or Ta is formed by a process such as vacuum evaporative deposition over the mask portions 41 and the surrounding substrated surface, from a direction oriented vertically with respect to the substrate main faces. The metal layer portions 41 are then removed by etching using an appropriate etching material, to thereby also remove the metal layer 35 portions which have been formed thereon, and so form the electron extraction apertures 37.

Further patterning of the metal layer 35 may be executed at this time, to appropriately mutually separate the electron extraction electrodes of different field emission cathodes, so that these electron extraction electrodes can be used as mutually independent modulation electrodes. Alternatively, the metal layer 35 may be deposited in step 13(*h*) in the form of a suitable pattern for interconnecting the electron extraction electrodes of specific field emission cathodes (e.g. as a parallel stripe pattern) for example as indicated in FIG. 15.

Next, as shown in FIG. 13(*j*), the metal layers 32*a*, 32*b* which surround each cathode material layer 34 portion within an electron extraction aperture 37 are subjected to processing such as chemical etching, to be removed to a predetermined depth, for example to a depth of 100 Å to 5 μm, leaving the upper part of the corresponding cathode material layer 34 portion protruding above the metal layer portions by a predetermined length. It is necessary to select the material used for the metal layer 35 and for the cathode material layer 34 such that these materials will not be corroded during this etching process.

Next, as shown in FIG. 13(*k*), the exposed surfaces of the metal layers 32*a*, 32*b* which have been etched in step 13(*j*) are subjected to processing such as anodic oxidation to form an electrically insulating layer thereon, formed of an oxide. The metal layers 32*a*, 32*b* are each preferably formed of Al or Ta, to enable this oxidation processing.

If necessary, if it is required to mutually interconnect specific ones of the cathode material layer 34 portions, an electrically insulating layer can be formed on the opposite face of the array substrate 40 to that having the electron extraction electrodes formed, suitably patterned to achieve the desired interconnections.

As shown in FIG. 15, an array of field effect cathodes produced as described above can be combined with a transparent substrate having a layer of photo-emissive material 14 formed on an inner face thereof, to form a flat panel display.

With the above embodiment of a method of manufacture, simply by transversely slicing across a multi-substrate block formed of plural superposed electrically insulating substrates having patterned layers formed thereon as described above, an array substrate can be obtained upon which exposed surfaces of the cathode material are exposed, arranged in a desired array configuration. Furthermore as a result of selectively forming the mask portions 41 over respective ones of these exposed regions of cathode material and subsequently removing the mask material, the electron extraction apertures for the field emission cathodes are formed very simply, as a result of removal of metal layer portions which lie upon the mask portions. This method enables accurate alignment of the electron extraction apertures 37 with the respective cathode material 34 portions, by a simple manufacturing process.

With the method of manufacture embodiment described above, the first metal layer 32*a* is formed in a predetermined pattern. However it would be equally possible to form the metal layer 32*a* over an entire face of the substrate 31, and to then form a predetermined pattern of cathode material layer 34 upon the first metal layer 32*a*, and to then form the second metal layer 32*b* over the entire area.

In addition, the method of manufacture embodiment above has been described for the case of a 2-dimensional array being produced. However it would be equally possible to form a one-dimensional array. This can be done by forming a multi-substrate block in which it is arranged that each patterned cathode material layer is sandwiched between two electrically insulating substrates, i.e. by superposing a substrate which does not have a cathode material layer upon a substrate which has a cathode material layer, or by combining two substrates each having a patterned cathode material layer, such that the matching regions of the cathode material are brought into contact. In addition, it would be possible to form a 2-dimensional array by combining a plurality of such one-dimensional arrays.

It should be noted that the above embodiment is not limited to forming point arrays of elements, but could also be applied to forming line arrays, or forming unit elements.

With the above embodiment of a field emission cathode, the shape of the tip of cathode element is determined by the thickness of a layer of cathode material, so that the tip can be made extremely small. This enables a high concentration of electric field to be attained, so that the electron extraction efficiency is high. In addition, a gap and an electrically insulating layer are formed between the cathode element formed of the cathode material and the electron extraction electrode, so that there is a high value of withstanding voltage between these. Thus, high reliability is attained.

Furthermore with the method of manufacture described above for that field emission cathode, the electron extraction aperture is formed by removal of a mask layer that has been formed over an array of exposed regions of the cathode material, with a metal layer that has been formed over the mask layer being also thereby removed. With this method, the manufacturing yield can be easily made high, and accurate alignment of the electron extraction apertures with the respective cathode material portions to be easily attained.

Figure 16:
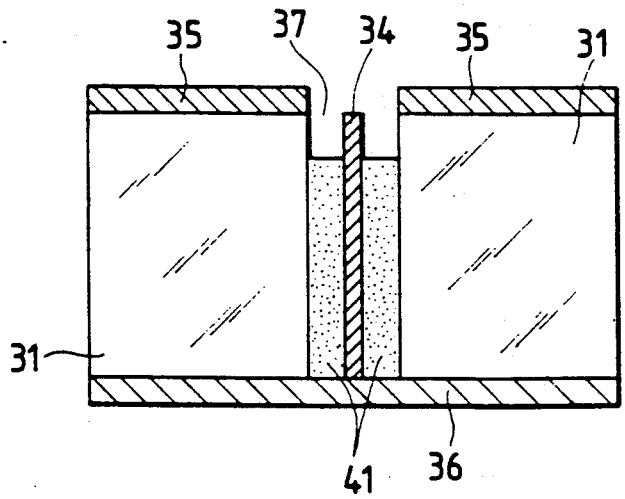
FIG. 16 is a is a partial cross-sectional view of another embodiment of a field emission cathode according to the present invention.
Figure 17A:
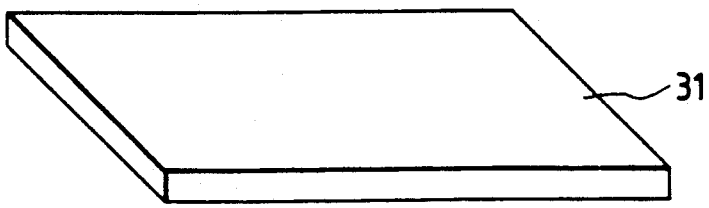
FIG. 17(*a*) through (*f*) are oblique views to illustrate a method of manufacture for the embodiment of FIG. 16.
Figure 17B:
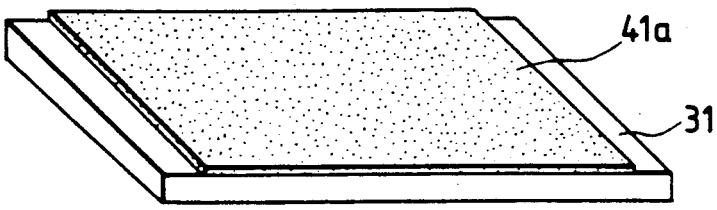
Figure 17C:
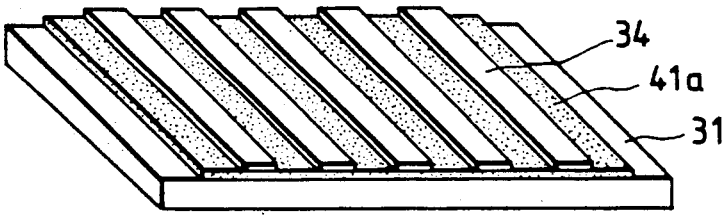
Figure 17D:
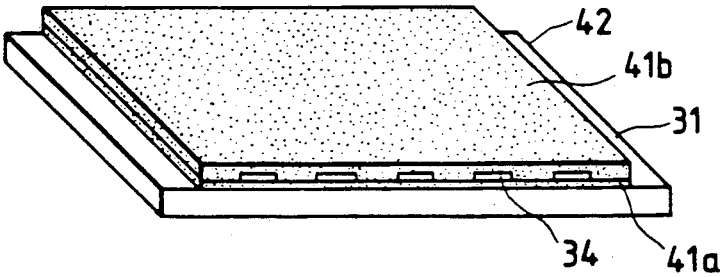
Figure 17E:
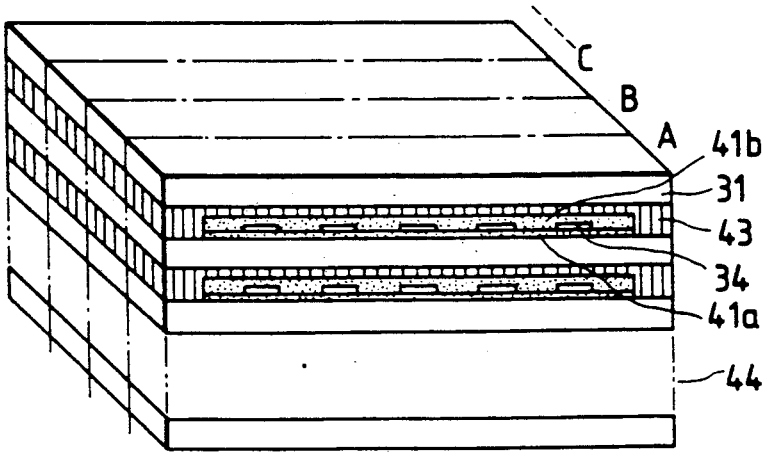
Figure 17F:
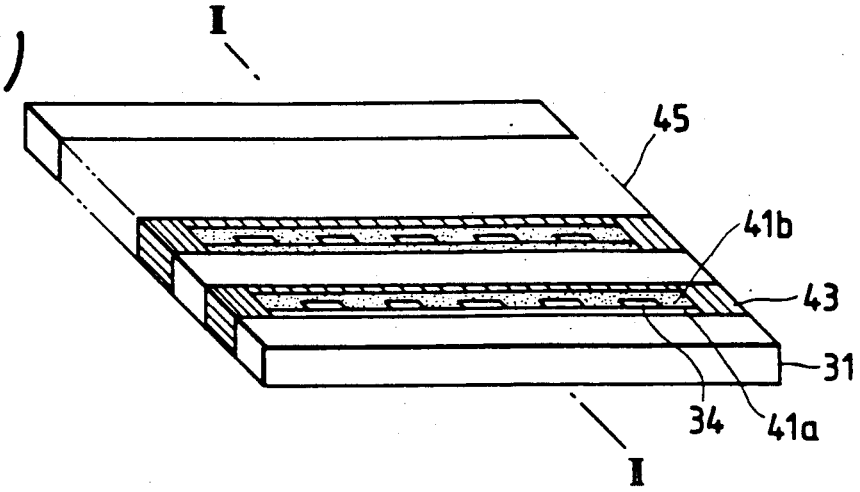
Figure 17G:
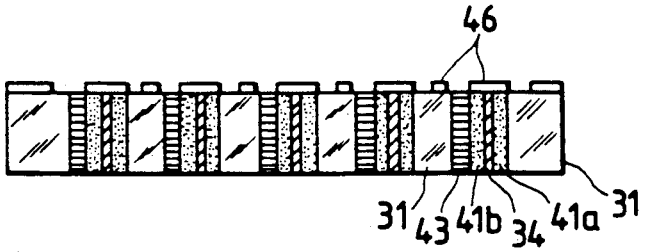
Figure 17H:
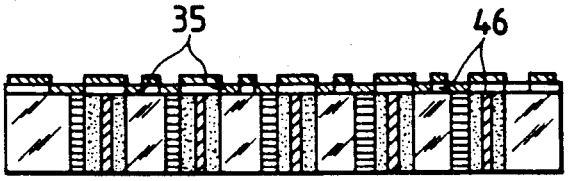
Figure 17I:
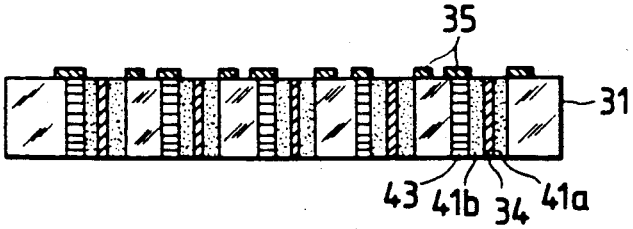
Figure 17J:
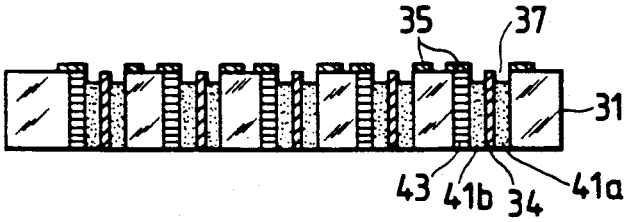
Figure 17K:
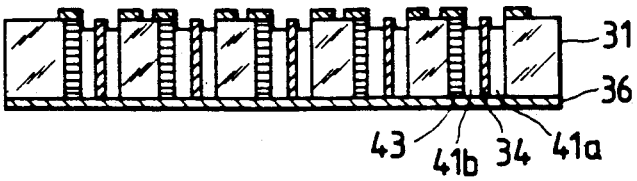

FIG. 16 a partial cross-sectional view of another embodiment of a field emission cathode according to the present invention. In this embodiment, a layer 41 of an electrically insulating material such as $Al_2O_3$, $SiO_2$, or $Si_3N_4$ is formed between mutually opposing faces of electrically insulating substrates 31 formed of a material such as glass or ceramic. A layer of cathode material 34 (formed of a material such as W, Mo, TiC, SiC, ZrC, or $LaB_6$) is disposed centrally between the aforementioned opposing substrate faces, within the layer 41, elongated in a direction parallel to these opposing substrate faces. The upper surface of the insulating layer 41 is made lower than an upper surface of the substrates 31. The top surface of the cathode material layer portion 34 extends above the insulating layer 41, to be at substantially co-planar with the upper surface of the substrates 31. The thickness of the cathode material portion 34 (as measured in a direction perpendicular to the aforementioned opposing faces of the substrates 31) is made approximately 100 Å to 2 μm. The upper face of the substrates 31 has a metal layer 35 formed thereon, to be used in forming an electron extraction electrode for the field emission cathode. This metal layer is formed of a material such as W, Mo or Ta.

If a plurality of field emission cathodes as shown in FIG. 16 are to form an array, then a patterned electrically conductive layer 36 can be formed on the opposite face of the substrate 31 to that on which the metal layer 35 is formed, with the layer 36 being in electrical contact with the cathode material 34.

With this embodiment, due to the fact that the dimensions of the tip of the cathode material layer 34 are determined by a film thickness, the tip size can be made extremely small, so that a high concentration of electric field can be easily achieved. Thus, effective extraction of electrons through the electron extraction aperture 37 can be obtained with only a low level of voltage being applied between the cathode material layer 34 and the electron extraction electrode 35. Furthermore, a gap and also the insulating layer 41 are disposed between the cathode material layer 34 and the metal layer 35, so that a high value of withstanding voltage between these, thereby ensuring high reliability.

A method of manufacture for this embodiment will be described in the following. FIGS. 17(*a*) to (*k*) show steps in this method. FIGS. 17(*a*) to (*f*) are partial oblique views illustrating manufacturing steps. FIGS. 17(*g*) to (*k*) are partial cross-sectional views showing further steps in the process, taken along line II—II in FIG. 17(*f*).

As shown in FIG. 17(*a*), an electrically insulating substrate 31 is first prepared, formed of a material such as glass or alumina ceramic, and has surfaces thereof polished to a sufficient degree of flatness. Next, as shown in FIG. 17(*b*), a first insulating layer 41*a* is formed over substantially one entire face of the substrate 31. The first insulating layer 41*a* is formed of a material such as $Al_2O_3$, $SiO_2$, or $Si_3N_4$, and is formed to a predetermined thickness (e.g. 0.5 to 5 μm), by a process such as sputtering deposition or CVD.

Next, as shown in FIG. 17(*c*), a patterned layer of a cathode material 34 is formed over the first insulating layer 41*a*, by a process such as sputtering deposition or CVD, to a predetermined thickness (e.g. 100 Å to 2 μm). In this example the cathode material layer 34 is patterned into parallel stripes, and is formed of a material such as W, Mo, TiC, SiC or ZrC. It should be noted that this embodiment is not limited to the use of a stripe pattern for the cathode material layer 34, and that it would be equally possible to use a grid pattern, a toothed pattern, etc, in accordance with requirements, and also to select the dimensions of the pattern in accordance with these requirements. The patterned cathode material layer 34 can be deposited by evaporative deposition through a mask, or by forming a layer of cathode material over the entire surface of the first insulating layer 41*a* by evaporative deposition or sputtering, then executing photo-etching.

Next, as shown in FIG. 17(*d*), a second insulating layer 41*b* (consisting of the same material as the first insulating layer 41*a*) is formed over the cathode material layer 34 by a process such as sputtering or CVD. This second insulating layer 41*b* covers substantially the same area as the first insulating layer 41*a*, and has a thickness of approximately 0.5 to 5 μm. A composite substrate 42 is thereby completed.

A plurality of these composite substrates 42 are manufactured, then as shown in FIG. 17(*e*) these are successively superposed to form a solid multi-substrate block 44, such that each set of three layers 41*a*, 34 and 41*b* is sandwiched between two of the substrates 31. The composite substrates 42 of this block are mutually attached at attachment sections 43, by welding or by means of adhesive material such as low melting point frit glass, or by a heat-resistant adhesive material. The attachment sections 43 can be placed at various positions, in accordance with specific requirements. Next, as shown in FIG. 17(*e*), the block 44 is sliced along the lines A, B, C, . . . such as to transversely cut through the stripe portions of cathode material layer 34, perpendicular to the direction of elongation of these stripe portions. The resultant sections formed from the block 44 are then mechanically polished to thereby obtain the array substrates 45, one of which is shown in oblique view in FIG. 17(*g*). This array substrate 45 has an array of of cathode material layer 34 portions, which defines the field emission cathode array pattern, with exposed regions of these cathode material layer 34 portions appearing on each of opposing faces of the substrate. Each of these cathode material layer 34 portions is enclosed between insulating layer 41*a* and 41*b* portions.

Next, as shown in FIG. 17(*g*), a patterned mask layer 46 is selectively formed upon one side of the substrate 45, this mask layer consisting of a metal layer having a predetermined thickness, deposited by the usual electroplating process. The mask layer 46 is patterned such as to cover the exposed regions of the insulating layers 41*a*, 41*b* and the cathode material layer 34, and also to cover portions of the surface of the substrate 31 which are in the form of elongated strip regions which extend between the insulating layer 41*a*, 41*b* portions. Alternatively, if the substrate 31 is formed of an optically transparent material, a pattern of photoresist can be utilized to form the mask layer 46. In that case, a layer of photoresist is first coated over one face of the array substrate 45, then the opposite face of the substrate 45 is illuminated with ultra-violet radiation, and the portions of the photoresist that have been exposed to the radiation then developed and removed, to leave mask portions corresponding to the metal layer portions 46 of FIG. 17(*g*).

After the mask portions have thus been formed, then as shown in FIG. 17(*h*), a an electrically conductive layer 35 for use in forming electron extraction electrodes, consisting of a material such as W, Mo or Ta is formed by a process such as vacuum evaporative deposition, sputtering deposition, or CVD over the mask portions 46 and the surrounding substrate surface. The mask portions 46 are then removed by etching using an appropriate etching material, to thereby at the same time remove the electrically conductive layer 35 portions which have been formed thereon, and so form electron extraction apertures 37.

Next, as shown in FIG. 17(*j*), part of the insulating layers 41*a*, 41*b* which surround each cathode material layer 34 portion within an electron extraction aperture 37 are subjected to processing such as chemical etching, to be removed to a predetermined depth, for example to a depth of 100 Å to 5 μm, leaving the upper part of the corresponding cathode material layer 34 portion protruding above the insulating layer portions by a predetermined length. It is necessary to select the material mused for the metal layer 35 and for the cathode material layer 34 such that these materials will not be corroded during this etching process. For example if the insulating layers 41*a*, 41*b* each consist of $Al_2O_3$ or $Si_3N_4$, then phosphoric acid is a suitable etching medium. If on the other hand each of the insulating layers 41*a*, 41*b* is formed of $SiO_2$, then fluoric acid is a suitable etching medium. Suitable materials for the electron extraction electrode 35 and cathode material 34 are W, Mo, etc.

If it is required to mutually interconnect specific ones of the cathode material layer 34 portions, an electrically insulating layer can be formed on the opposite face of the array substrate 45 to that having the electron extraction electrodes formed, suitably patterned to achieve the desired interconnections.

A field emission cathode array formed by the above method of manufacture is suitable for combining with a transparent substrate having a layer of photo-emissive material 14 formed on an inner face thereof, to form a flat panel display.

With the above method of manufacture, simply by transversely slicing across a multi-substrate block 44 formed of plural successively superposed substrates having patterned layers formed thereon as described above, an array substrate 45 can be obtained upon which exposed surfaces of the cathode material 34 are arranged in a desired array configuration. Furthermore as a result of selectively forming the mask portions 46 over respective ones of these exposed regions of cathode material and subsequently removing the mask material, the electron extraction apertures for the field emission cathodes can be formed by removal of electrically conductive layer portions which lie upon the mask portions. Thus, this method also enables accurate alignment of the electron extraction apertures 37 with the respective cathode material 34 portions, by a simple manufacturing process.

Figure 18A:
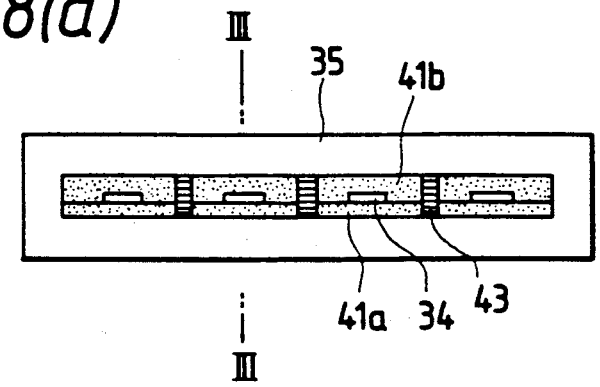
FIG. 18*a* is a partial view in plan of a corresponding 1-dimensional array portion, and FIG. 18(*b*) is a partial view in plan showing the array of FIG. 18(*a*) with electron extraction electrodes removed.
Figure 18B:
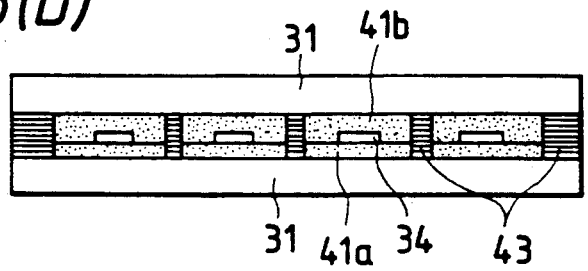
FIGS. 18(*a*) and (*b*) show a second example of a method of manufacture for the embodiment of FIG. 16, where

FIGS. 18*a* and 18*b* are diagrams for describing another method of manufacturing for the field emission cathode embodiment of FIG. 16. FIG. 18*a* is a plan view showing a one-dimensional array, while FIG. 18*b* is a plan view showing the one-dimensional array of FIG. 18*a* with an electron extraction electrode removed.

With this embodiment, as shown in FIG. 18*a*, 18*b*, insulating layers 41*a* and 41*b* are formed as respective patterns of stripes which are wider than respective stripe-shaped layer portions of cathode material 34, rather than being formed as continuous layers as in the previous embodiment (as indicated in FIGS. 17(1), 17(*d*)). Attachment sections 43 are provided between these stripe pattern portions, to mutually attach successive substrates to obtain a superposed-substrate block, as for the multi-substrate block 44 shown in FIG. 17(*e*). Apart from the above points, the remainder of this method of manufacture is identical to that of FIGS. 17(*a*) to (*d*) described above.

A cross-sectional view taking along line III—III in FIG. 18(*a*) corresponds to FIG. 16.

Figure 19A:
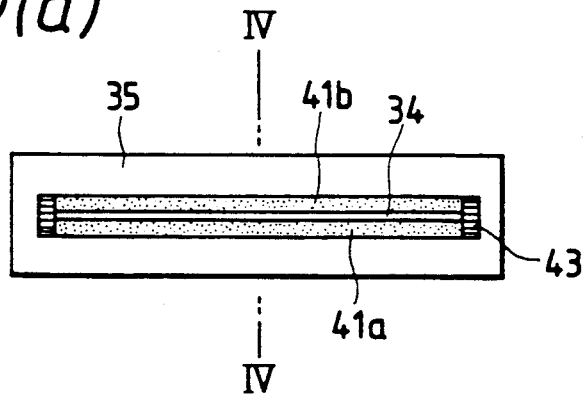
FIG. 19*a* is a plan view of a 1-dimensional array, and FIG. 19(*b*) is a plan view showing the array of FIG. 19(*a*) with electron extraction electrodes removed.
Figure 19B:
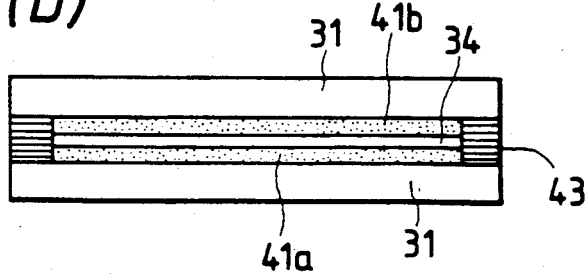

FIG. 19(*a*) and (*b*) are plan views for illustrating another method of manufacture for the fet embodiment of FIG. 16. FIG. 19(*a*) shows a portion of an array substrate manufactured by this method, while FIG. 19(*b*) shows the array substrate of FIG. 19(*a*) without a metal layer for electron extraction electrodes. With this embodiment, the cathode material 34 is formed as a continuous layer, between opposing continuous layers of insulating layer (41*a*, 41*b*), rather than being formed as a plurality of stripe layer portions as in the previous embodiment (as indicated in FIG. 17(*c*)). Apart from the above points, the remainder of this method of manufacture is identical to that of FIGS. 17(*a*) to (*d*) described above.

What is claimed is:

1. A field emission cathode comprising:

a pair of electrically insulating substrates having at least respective upper faces thereof aligned in a common plane and with a gap formed between opposing side faces thereof;

a first metal layer formed within said gap, extending between said side faces;

a layer of electrically insulating material formed within said gap, extending between said side faces and in contact with a surface of said first metal layer and having a surface thereof recessed below said common plane;

a layer of cathode material formed extending substantially parallel to said side faces and positioned centrally between said side faces, extending within said metal layer and insulating layer, and with one end thereof protruding from said recessed surface of said electrically insulating layer; and a second metal layer formed on said upper faces of said substrates, extending to said gap, to function as an electron extraction electrode.

2. A field emission cathode according to claim 1, in which the thickness of said cathode material, as measured in a direction perpendicular to said side faces, is in a range of 100 Å to 1 μm.

3. A field emission cathode according to claim 1, in which said second metal layer is formed of a material which is resistant to corrosion by predetermined etching liquids.

4. A field emission cathode according to claim 1, in which said first metal layer is formed of a metal selected from a group which consists of Al and Ta.

5. A field emission cathode according to claim 1, in which said cathode material is selected from a group of materials which consists of Mo, TiC, SiC, ZrC, and $LaB_6$.

6. A field emission cathode comprising:

a pair of electrically insulating substrates having at least respective upper faces thereof aligned in a common plane and with a gap formed between opposing side faces thereof;

a layer of electrically insulating material formed within said gap, extending between said side faces, and having a surface thereof recessed below said common plane;

a layer of cathode material formed extending substantially parallel to said side faces and positioned centrally between said faces, extending within said electrically insulating layer, with one end thereof protruding from said recessed surface of said insulating layer; and a second metal layer formed on said upper faces of said substrates, extending to said gap, to function as an electron extraction electrode.

7. A field emission cathode according to claim 6, in which the thickness of said cathode material, as measured in a direction perpendicular to said side faces, is in a range of 100 Å to 2 μm.

8. A field emission cathode according to claim 6, in which said cathode material is selected from a group of materials which consists of Mo, TiC, SiC, ZrC, and $LaB_6$.

* * * * *